US005405095A

United States Patent [19]

Lesar

[11] Patent Number: 5,405,095

[45] Date of Patent: Apr. 11, 1995

[54] KNIFE HOLDER AND KNIFE ASSEMBLY FOR USE IN A HAND MATERIAL COLLECTING SYSTEM FOR A GRINDER

[75] Inventor: Nick J. Lesar, Palmyra, Wis.

[73] Assignee: Weiler and Company, Inc., Whitewater, Wis.

[21] Appl. No.: 133,506

[22] Filed: Oct. 7, 1993

Related U.S. Application Data

[63] Continuation of Ser. No. 856,665, Mar. 24, 1992, Pat. No. 5,344,086, which is a continuation-in-part of Ser. No. 778,010, Oct. 17, 1991, Pat. No. 5,289,979, which is a continuation-in-part of Ser. No. 654,942, Feb. 13, 1991, Pat. No. 5,251,829.

[51] Int. Cl.[6] ..... B02C 18/30; B02C 18/36

[52] U.S. Cl. ..... 241/82.5; 241/260.1; 241/292.1

[58] Field of Search ..... 241/82.1–82.7, 241/260.1, 292.1, 294

[56] References Cited

U.S. PATENT DOCUMENTS

| | | | |
|---|---|---|---|
| 737,783 | 9/1903 | Schyia . | |
| 1,239,237 | 9/1917 | Von Wolforsdorf | 241/292.1 |
| 1,514,271 | 11/1924 | Tilden . | |
| 1,703,762 | 2/1929 | Brown, Jr. | 241/292.1 |
| 1,736,550 | 11/1929 | Schmidt . | |
| 1,986,933 | 1/1935 | Laemmel | 241/292.1 |
| 1,986,934 | 1/1935 | Laemmel | 241/292.1 |
| 2,166,197 | 7/1939 | Schaub . | |
| 2,640,033 | 5/1953 | Marshall . | |
| 2,665,725 | 1/1954 | Lundell | 241/82.6 |
| 2,861,612 | 11/1958 | Euerle . | |
| 2,914,103 | 11/1959 | Ferris . | |
| 2,916,069 | 12/1959 | Williams . | |
| 3,340,917 | 9/1967 | Vedvik . | |
| 3,734,148 | 5/1973 | McCulty . | |
| 3,739,994 | 6/1973 | McFarland . | |
| 3,762,658 | 10/1973 | Barnes . | |
| 3,847,360 | 11/1974 | Seydelmann . | |
| 3,889,885 | 6/1975 | Couture | 241/292.1 |
| 3,917,178 | 11/1975 | Barnes . | |
| 3,934,827 | 1/1976 | Seydelmann . | |
| 4,004,742 | 1/1977 | Hess . | |
| 4,014,075 | 3/1977 | van Bergen . | |
| 4,141,113 | 2/1979 | Van Bergen . | |
| 4,153,208 | 5/1979 | Vomhof et al. . | |
| 4,189,104 | 2/1980 | dos Santos . | |
| 4,202,502 | 5/1980 | Laska . | |
| 4,358,061 | 11/1982 | Richter . | |
| 4,422,582 | 12/1983 | Roeger et al. . | |
| 4,536,920 | 8/1985 | Amersfoort . | |
| 4,613,085 | 9/1986 | Simonsen . | |
| 4,699,325 | 10/1987 | Hess . | |
| 4,700,899 | 10/1987 | Powers et al. . | |
| 4,795,104 | 1/1989 | Rudibaugh . | |
| 4,928,892 | 5/1990 | Huebner et al. . | |
| 5,041,055 | 8/1991 | Roth . | |
| 5,251,829 | 10/1993 | Lesar | 241/30 |
| 5,289,979 | 3/1994 | Lesar | 241/82.6 |

FOREIGN PATENT DOCUMENTS

| | | |
|---|---|---|
| 144062 | 7/1935 | Austria . |
| 497115 | 11/1950 | Belgium . |
| 521637 | 2/1956 | Canada . |
| 1157042 | 5/1958 | France . |
| 2242151 | 3/1975 | France . |
| 587177 | 4/1932 | Germany . |
| 2809609 | 9/1979 | Germany . |
| 3820316 | 12/1989 | Germany . |
| 257407 | 9/1926 | United Kingdom . |
| 726754 | 3/1955 | United Kingdom . |
| 1353506 | 11/1987 | U.S.S.R. . |

*Primary Examiner*—Frances Han

*Attorney, Agent, or Firm*—Andrus, Sceales, Starke & Sawall

[57] ABSTRACT

An arrangement for discharging hard material from the grinding head of a meat grinder. The hard material is passed through openings formed in the meat grinder orifice plate, and collected in a collection cavity defined by a cup member. A hard material discharge auger is located within the collection cavity, and is rotatable with the feed screw of the grinder. A restricting arrangement is provided for building up back pressure within the collection cavity, which minimizes the amount of usable soft material which passes into the collection cavity. In one form, the discharge auger extends through the collection cavity and into a discharge passage defined by a discharge tube. The auger has an outside diameter only slightly smaller than the diameter of the passage, so that the auger essentially defines a rotating flow path through which the hard material is discharged.

7 Claims, 13 Drawing Sheets

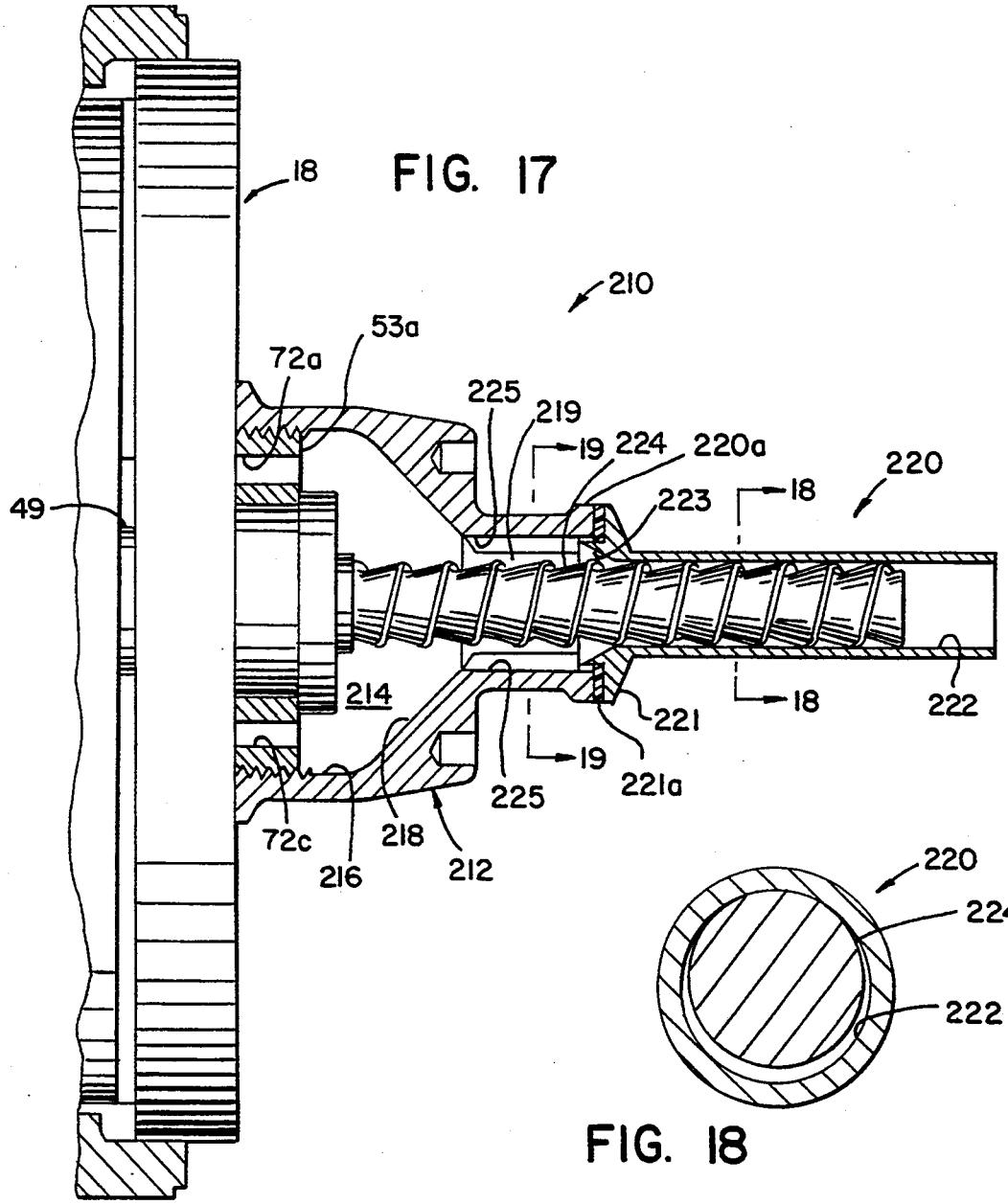
FIG. 17
FIG. 18
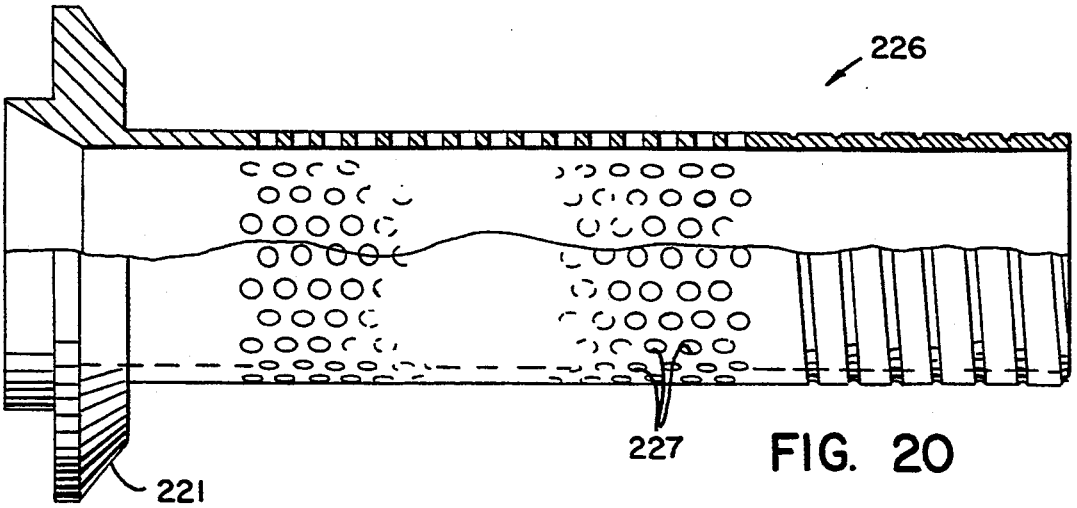
FIG. 20

FIG. 22
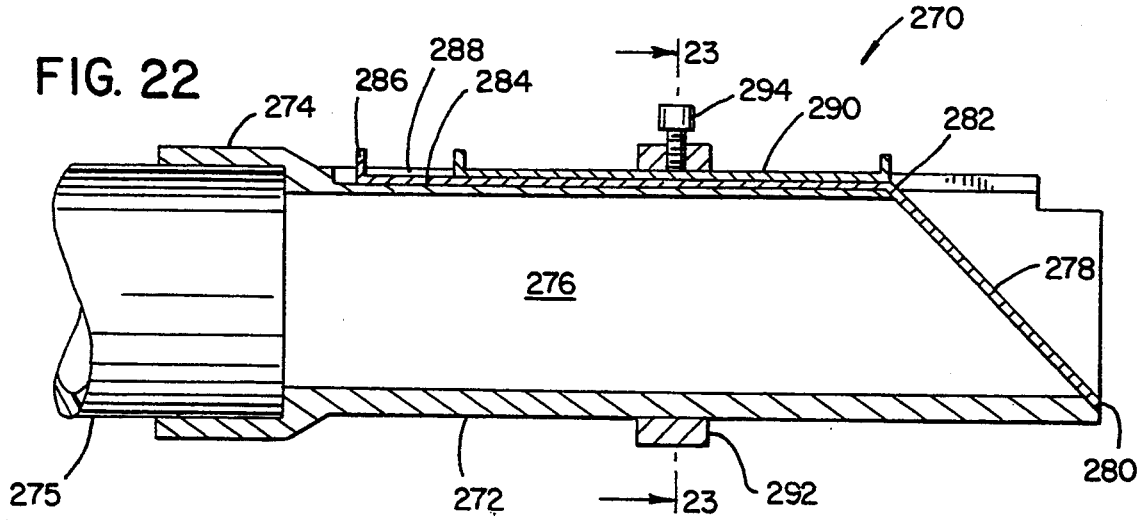
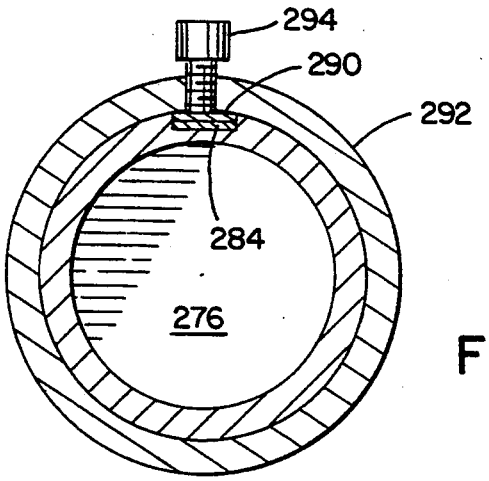
FIG. 23

FIG. 26
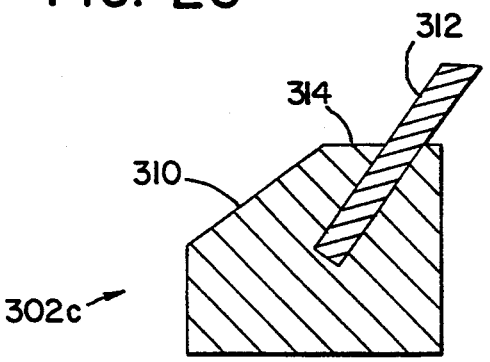
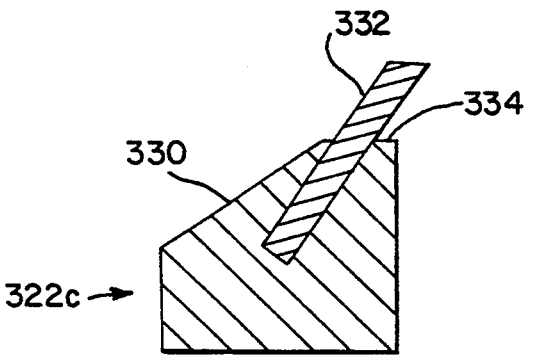
FIG. 29
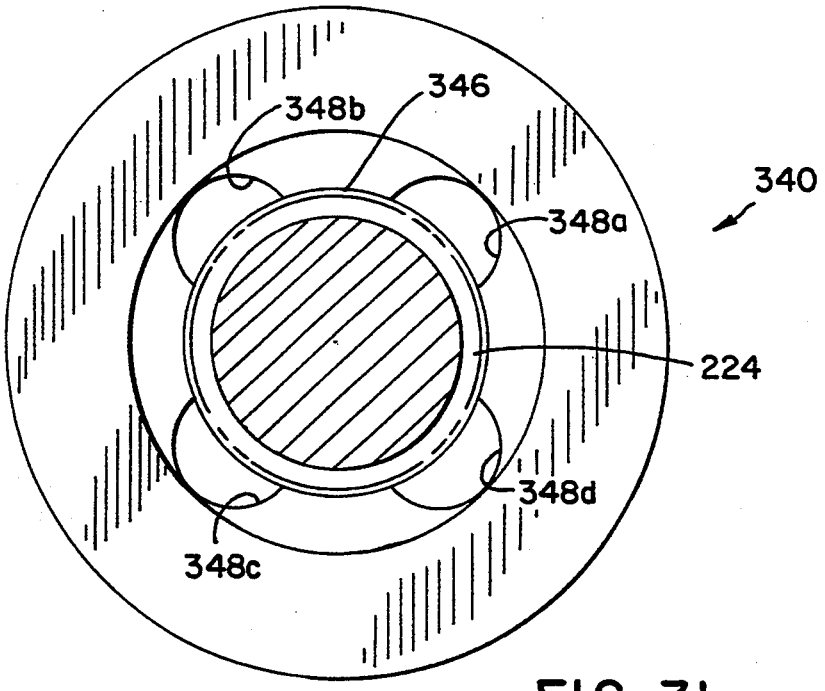
FIG. 31

KNIFE HOLDER AND KNIFE ASSEMBLY FOR USE IN A HAND MATERIAL COLLECTING SYSTEM FOR A GRINDER

CROSS REFERENCE TO RELATED APPLICATION

This application is a continuation of application Ser. No. 07/856,665, filed Mar. 24, 1992, now U.S. Pat. No. 5,344,086, issued Sep. 6, 1994, which is a continuation-in-part of application Ser. No. 07/778,010, filed Oct. 17, 1991, now U.S. Pat. No. 5,289,979 which in turn is a continuation-in-part of application Ser. No. 07/654,942, filed Feb. 13, 1991, now U.S. Pat. No. 5,251,829, issued Oct. 12, 1993.

BACKGROUND AND SUMMARY

This invention relates to a grinder such as for use in grinding meat, and more particularly to features for use with a meat grinder which facilitate removal of hard material such as bone, sinew or gristle so that such materials are not ground along with the meat.

In high volume production of ground meat, it is common for the meat being ground to contain hard materials such as bone, sinew, gristle or the like. It is desirable to remove such material prior to or during grinding of the meat, to ensure that the hard material is not ground along with the meat.

A meat grinder typically includes an orifice plate located at the open end of a tubular housing, and a rotating knife assembly provides a series of knives disposed against a surface of the orifice plate. The knives are mounted to a knife holder, which typically comprises a series of radial arms extending outwardly from a central hub. To remove hard material during grinding, it has been known to provide a series of collection orifices towed the central potion of the orifice plate. With a system of this type, rotation of the knife assembly moves the hard material around the orifice plate, with the hard material eventually moving its way toward the center of the orifice plate, where it is received into one of the collection orifices.

A system such as that summarized above generally works satisfactorily to remove hard material from meat during grinding of the meat. However, it has been found that with a lower grade of meat being ground, which contains a greater amount of hard material than higher grade meat, it is nearly impossible for such a system to remove substantially all of the hard material during grinding of the meat.

Accordingly, the present invention has as its object to provide a hard material collection system for use with a meat grinder, which enhances the ability of the grinder to collect hard material during grinding of the meat. It is a further object of the invention to provide a hard material collection system which is used in connection with a conventional grinding system, in which a feed screw advances the meat through a housing toward an orifice plate, and in which a rotating knife assembly is disposed toward the end of the feed screw against the inner surface of the orifice plate. It is further an object of the invention to provide a hard material collection system which is relatively simple in design and in installation, yet which provides a greatly increased ability to collect hard material prior to passing of the hard material through the meat grinding orifices of the orifice plate.

In accordance with one aspect of the invention, a series of spaced collection openings or passages are located toward the center of the orifice plate for collecting hard material such as bone, gristle, sinew or the like. Each collection opening includes a ramped entryway opening onto the surface of the orifice plate facing the knife assembly. The collection openings are relatively large openings, and are located inwardly of relatively small outer openings through which the soft material passes. The ramped entryway to each collection opening extends outwardly toward the outer openings. The collection openings are preferably oval or kidney shaped in plan, and the ramped entryways extend outwardly along one of the long sides of each collection opening. The ramped entryways assist in feeding hard material into the collection openings, and also cooperate with the ends of the collection openings to define shearing edges. When a piece of hard material which is larger than the collection opening is directed into one of the collection openings by the ramped entryway associated therewith, the hard material lodges in the collection opening. Movement of the knife assembly over the collection opening shears off the hard material against the shearing edge defined by the ramped entryway in combination with the end of the collection opening. The portion of the piece of the hard material within the collection opening thereafter passes through the collection opening, and the portion which is sheared off is directed into another collection opening for repeated shearing until it is of a size small enough to pass through a collection opening.

In accordance with another aspect of the invention, the rotating knife assembly includes a central hub and a plurality of knife holding arms extending outwardly from the hub, with a knife mounted to each knife holding arm. The arms are arranged so as to be non-radial relative to the hub, thereby providing non-radial mounting of the knives. This arrangement facilitates movement of the hard material inwardly toward the hub during rotation of the knife assembly. In a preferred embodiment, the hub is provided with a collection pocket forwardly of each knife holding arm for receiving hard material moved inwardly toward the hub during rotation of the knife assembly. The collection pockets on the hub are preferably located in alignment with the collection openings in the orifice plate. The collection openings preferably include ramped entryways as described above for facilitating entry of hard material into the collection openings. Each collection pocket preferably includes an outwardly facing ramped area provided on the hub forwardly of each knife holding arm. In a preferred arrangement, each arm includes a base connected to the hub and an outer end spaced outwardly from the base. The knife holding arms are constructed such that each arm includes a rearwardly facing ramped surface located rearwardly of each knife. The ramped surface of each arm merges with the outwardly facing ramped area of an adjacent one of the collection pockets. The ramped surfaces of the arms define low pressure areas to which hard material migrates upon rotation of the knife assembly. Such material passes through the low pressure areas into the collection pockets, and to the collection passages in the orifice plate. Each arm is arranged so as to provide a positive rake relative to the center of the hub. The longitudinal axis of each arm is preferably tangential to a circle concentric with the center of the hub. In a particularly preferred arrangement, the longitudinal axis of each arm is tangential to a common circle concentric with the center of the hub. In one embodiment, the arms are arranged such that the longitudinal axis of each arm is substantially perpendicular to the longitudinal axes of its adjacent arms.

In accordance with yet another aspect of the invention, the knife holder includes a hub and a plurality of knife holding arms extending outwardly therefrom, with a substantially central passage formed in the hub and adapted to receive a centering shaft therethrough. Each knife holding arm has a forwardly opening knife mounting slot formed therein, with each slot opening into the central passage in the hub. A knife mounting pin extends transversely through each knife mounting slot, and is located toward the outer end of each knife holding arm. Each knife is provided with an outwardly opening pin-receiving slot adapted to receive the knife mounting pin therein, wherein the centering shaft and the knife mounting pins cooperate to maintain the knives in position within the slots. This mounting structure acts to positively retain the knives in the knife holder once the centering shaft is inserted through the central passage formed in the hub.

In accordance with a further aspect of the invention, a collection cup, defining an internal collection cavity, is mounted downstream of the orifice plate for receiving hard material discharged through the orifice plate collection openings. A secondary discharge auger is mounted to and rotatable with the rotating knife assembly, to move the hard material through the collection cavity. A discharge tube is located downstream of the collection cavity, and defines a discharge passage for receiving discharged hard material from the collection cavity. The discharge auger extends into the discharge passage. In a particularly preferred embodiment, the auger has an outside diameter in very close tolerance with the inside wall of the discharge tube which defines the discharge passage. The auger then defines a rotating flow path for moving the hard material downstream through the discharge passage. The discharge passage preferably includes a series of radially spaced axial flutes which open into the discharge passage. Hard material is passed through the flutes upon rotation of the discharge auger. The discharge auger and the discharge tube cooperate to maintain relatively high pressure within the collection cavity, which insures that primarily hard material passes through the orifice plate collection openings and into the collection cavity. The collection cavity preferably includes an axial passage in its downstream end. A set of longitudinally extending flutes are preferably located in the collection cavity axial passage, for assisting in reducing the hard material particles in size and to provide a passage for the hard material particles into the discharge tube. An expansion chamber is preferably disposed between the collection cavity axial passage and the discharge passage, and also downstream of the discharge passage, to assist in moving the hard material through the discharge tube.

In accordance with a further aspect of the invention, a recovery grinding arrangement is provided downstream of the orifice plate. The recovery grinding arrangement recovers and grinds any soft material which may have passed through the collection openings along with the hard material. The recovery grinding arrangement includes a housing having a rotating recovery knife assembly located within its interior. Material passing through the collection openings is routed to the interior of the housing. In one embodiment, a secondary orifice plate is mounted to the end of the housing, and the soft material is forced by the rotating knife assembly through orifices formed therein. The recovered soft material is then mixed with the ground soft material discharged from the primary orifice plate. In another embodiment, a series of orifices are formed in an upper side wall of the housing. The rotating knife assembly forces the recovered soft material upwardly through the orifices, where it mixes with the soft material discharged from the primary orifice plate. In both embodiments, a discharge tube is connected at the outer end of the housing, and includes an internal passage in communication with the interior of the housing. The hard material is routed by the rotating knife assembly to the internal passage of the discharge tube. The secondary discharge auger is connected to the rotating knife assembly, and is disposed within the internal passage of the discharge tube for passing the hard material therethrough. In another embodiment, the recovery grinding arrangement comprises an extended portion of the secondary discharge auger, in combination with an adaptor, which is connected to the collection cup and which receives the inner end of a discharge conduit. The adaptor defines an internal passage having an inside diameter only slightly larger than the outside diameter of the discharge auger, so that the discharge auger defines a rotating flow path for moving hard material through the adaptor passage and into the discharge conduit. The adaptor includes a series of openings along the portion of the adaptor passage within which the discharge auger is located. Any soft material which may be present with the hard material being conveyed through the adaptor passage is squeezed out through the openings formed in the adaptor. The discharged soft material is typically fat, and can either be mixed with the ground product discharged through the orifice plate, or it can be collected for regrinding or for some other use.

In accordance with a further aspect of the invention, a flexible member is located adjacent the outlet of the collection cavity, and is provided with an aperture therethrough for discharging particles of hard material through the aperture from the collection cavity. The secondary discharge auger advances hard material toward the collection cavity outlet. The collection cavity includes a tapered portion defined by structure including one or more inner walls which taper inwardly toward the collection cavity outlet, to define a decreasing transverse dimension to the collection cavity in a direction toward its outlet. An axial passage extends outwardly from the outer end of the tapered portion, and defines the collection cavity outlet. The axial passage is interposed between the collection cavity tapered portion and the flexible member, and the discharge auger extends into the axial passage to force hard material through the axial passage toward the flexible member. The axial passage includes a series of spaced longitudinal flutes through which the hard material passes. A tapered passage is interposed between the collection cavity outlet and the flexible member, to provide a restriction in the flow of hard material toward the flexible member. The tapered passage is defined by a removable insert placed within a sleeve, with the flexible member also being located within the sleeve. A removable mounting arrangement secures the insert and the flexible member within the sleeve. A hard material conduit defines a discharge passage located downstream of the collection cavity outlet, with the flexible member being interposed between the discharge passage and the collection cavity outlet. Particles of hard material are discharged through the flexible member aperture into the discharge passage.

In accordance with a further aspect of the invention, a flow-controlling nozzle is mounted to the end of the discharge conduit, to control the pressure within the collection cavity. The nozzle includes an arrangement for variably controlling the flow rate of hard material through the discharge passage, and thereby the pressure of material therewithin. The nozzle consists of a valve body connected to the end of the discharge conduit and including an internal passage having an inlet end for receiving hard material from the conduit, and an outlet end terminating in a nozzle discharge opening. A movable valve member is mounted to the valve body over the discharge opening. The valve member is movable between an open position and a closed position, and is normally in its closed position. Flow of hard material through the valve body passage toward its outlet end results in engagement of the hard material with the valve member, to move the valve member away from its closed position and to allow the hard material to be discharged through the nozzle discharge opening. The valve member is preferably biased toward its closed position, and is mounted to the valve body by means of an arrangement which provides adjustability in the amount of force required to move the valve member away from its closed position. In one form, the valve body is constructed so as to define a valve seat oriented at an angle to the longitudinal axis of the valve body internal passage, with the nozzle discharge opening being formed in the valve seat. The movable valve member comprises a valve plate engagable with the valve seat so as to normally close the nozzle discharge opening. Adjustability in the biasing of the valve plate toward its closed position is provided by a clamping arrangement which mounts the valve plate to the valve body. The valve plate includes an elongated mounting portion engaged by the clamping arrangement to maintain the valve plate in position relative to the valve body. The clamping arrangement is movable to varying positions on the valve body, such that the degree of resistance provided by the valve plate to flow of hard material through the nozzle discharge opening can be varied. The output of hard material through the nozzle discharge opening is thereby controlled, to control the pressure within the passage defined by the discharge conduit. This aspect of the invention provides a low cost and efficient means to regulate pressure in the hard material discharge passage, and thereby the amount of soft material which is collected along with the hard material, to minimize waste of soft material.

In a particularly preferred embodiment of the invention, the various aspects and features as summarized above are combined into a single structure for facilitating advancing of hard material toward the center of the orifice plate during grinding and passage of the hard material into the collection openings formed in the orifice plate, and for recovering soft material which may pass through the collection openings along with the hard material.

Various other features, advantages and objects of the invention will be made apparent from the following description taken together with the drawings.

BRIEF DESCRIPTION OF THE DRAWINGS

The drawings illustrate the best mode presently contemplated of carrying out the invention.

In the drawings:

FIG. 17 is a partial cross-sectional view showing an alternate hard material discharge system constructed according to the invention;

FIG. 18 is a section view taken along line 18—18 of FIG. 17;

FIG. 20 is a side elevation view showing an adaptor for use with the system of FIG. 17 for providing recovery grinding of soft material;

FIG. 22 is a partial sectional view showing the flow-controlling nozzle at the end of the hard material discharge conduit;

FIG. 23 is a section view taken along line 23—23 of FIG. 22;

FIG. 26 is a section view taken along line 26—26 of FIG. 25;

FIG. 29 is a section view taken along line 29—29 of FIG. 28;

FIG. 31 is an end elevation view of the discharge tube of FIG. 30, reference being made to line 31—31 of FIG. 30.

DETAILED DESCRIPTION OF THE INVENTION

Figures 1, 3:
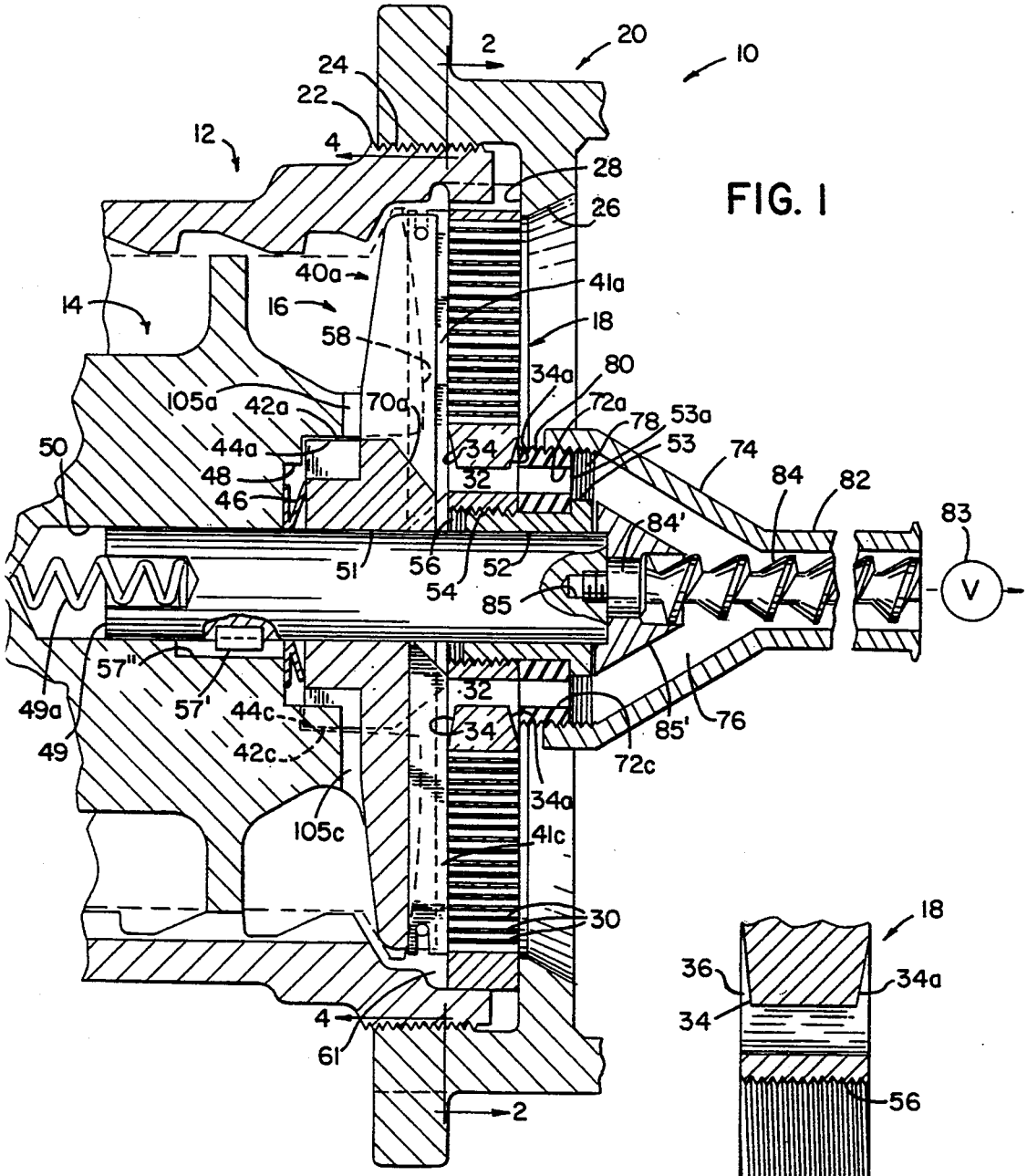
FIG. 1 is a partial cross-sectional view through the grinding head of a meat grinding machine, showing the features of the invention incorporated therein.
FIG. 3 is an enlarged partial sectional view showing the central portion of the orifice plate, with the collection openings extending therethrough.

FIG. 1 illustrates the grinding head 10 of a meat grinder, which includes a tubular housing 12 within which a feed screw 14 is rotatably mounted. Housing 12 and feed screw 14 are generally constructed as is known in the art so that, upon rotation of feed screw 14 within housing 12, meat or the like is advanced within the interior of housing 12 toward grinding head 10.

A knife assembly, shown generally at 16, is mounted at the end of the feed screw 14. Knife assembly 16 is disposed against the inner surface of an orifice plate, generally shown at 18, which is secured in the open end of housing 12 by a mounting ring, shown generally at 20. In accordance with known construction, the end of housing 12 is provided with a series of external threads 22, and mounting ring 20 includes a series of internal threads 24, adapted to engage external threads 22 on housing 12. Mounting ring 20 further includes an opening 26 defining an inner lip 28, which is adapted to engage the outer peripheral portion of orifice plate 18 to maintain orifice plate 18 in position within the open end of housing 12.

Figure 2:
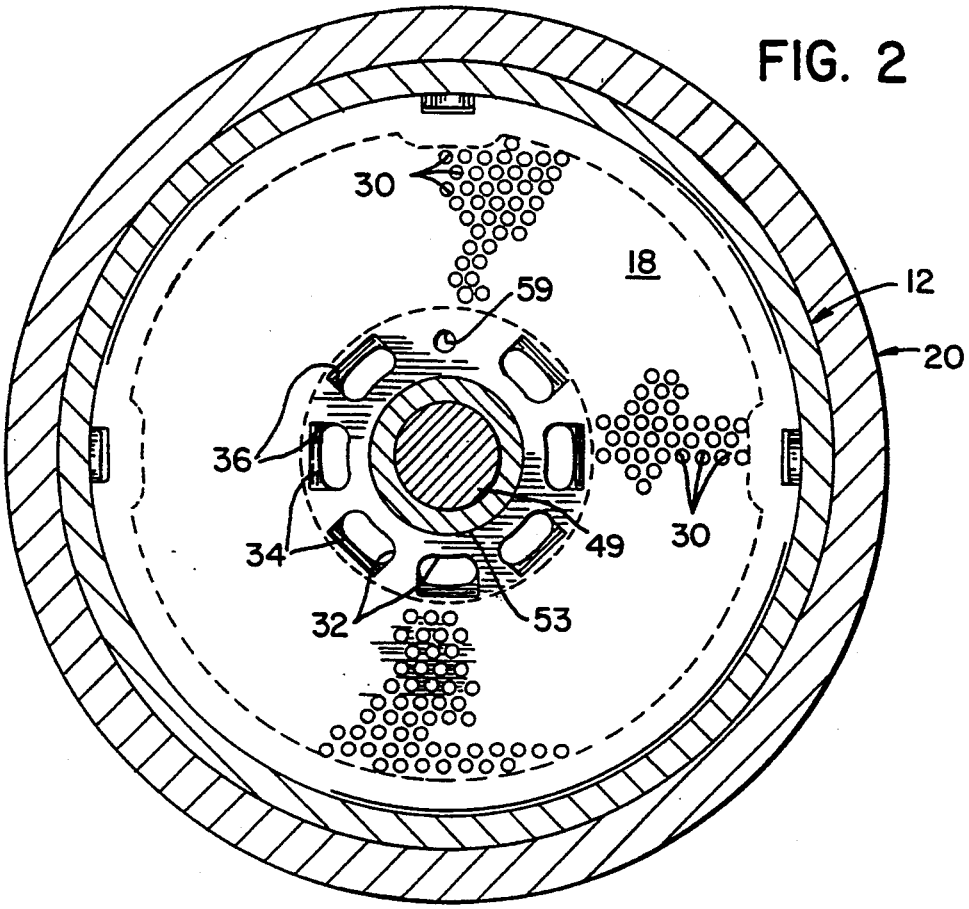
FIG. 2 is a sectional view taken generally along line 2—2 of FIG. 1.

Referring to FIGS. 1 and 2, orifice plate 18 is provided with a large number of relatively small grinding openings therethrough, such as shown at 30. The size of outer openings 30 varies according to the type of meat being ground. Generally, however, grinding openings 30 range from 3/32 inch to ½ inch in diameter. In accordance with known grinding principles, meat within the interior of housing 12 is forced toward orifice plate 18 by rotation of feed screw 14 and through openings 30, with rotating knife assembly 16 acting to sever the meat against the inner surface of orifice plate 18 prior to the meat passing through openings 30 in orifice plate 18.

As is also shown in FIGS. 1 and 2, a series of relatively large inner collection openings or passages 32 are formed in orifice plate 18 inwardly of the outer grinding openings 30. Collection openings 32 are located at a common radius from the center of orifice plate 18, and are equally radially spaced from each other. Collection openings 32 are generally oval or slightly kidney-shaped. Illustratively, collection openings 32 are approximately one inch long and three-eighths of an inch wide. As will be explained, collection openings 32 act to collect bone, gristle, sinew or other hard material prior to its passing through grinding openings 30 in orifice plate 18 during operation of grinding head 10.

Each of collection openings 32 is provided with a ramped entryway 34 opening onto the inner surface of orifice plate 18. Ramped entryways 34 are disposed at an angle of approximately 8 degrees to the surface of orifice plate 18, and extend outwardly from collection openings 32 in a direction toward the outer grinding openings 30. In a preferred embodiment, both the inner and outer surfaces of orifice plate 18 are provided with ramped entryways 34 leading into collection orifices 32. This arrangement accommodates mounting of orifice plate 18 at the end of housing 12 such that either of its surfaces can be employed as the inner cutting surface against knife assembly 16. In FIG. 1, the ramped entryways formed in the outer surface of orifice plate 18 are shown at 34*a*.

The end walls formed by each of the ramped entryways 34 provide shearing surfaces such as shown at 36, the purpose of which will later be explained.

Figure 4:
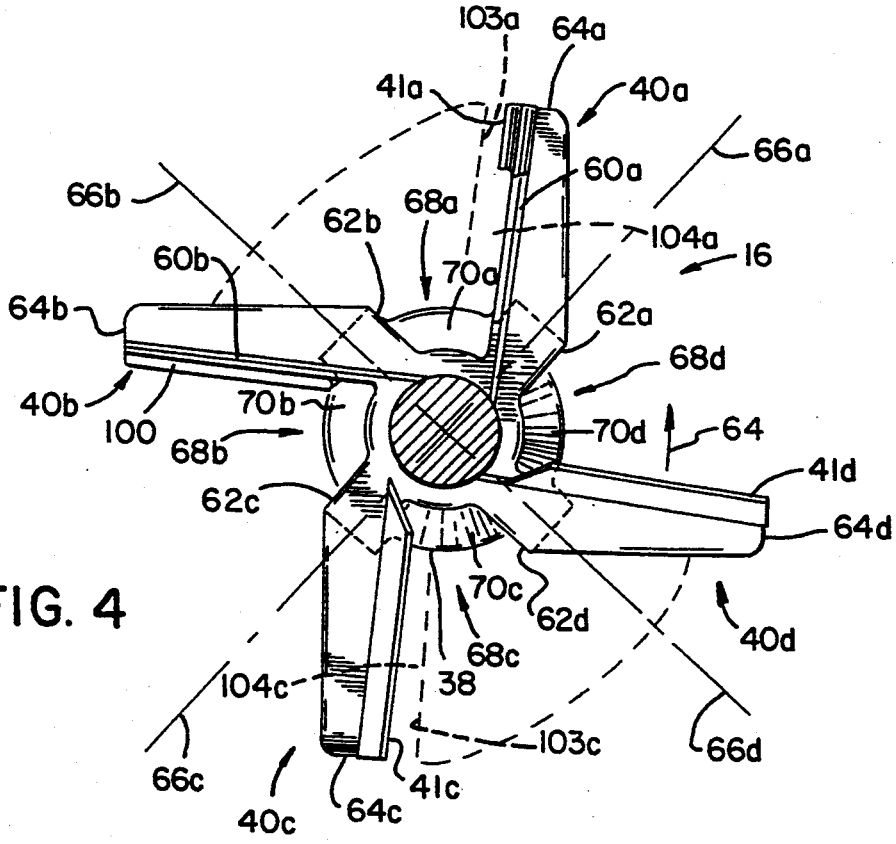
FIG. 4 is an end elevation view showing the knife holder assembly of the invention, reference being made to line 4—4 of FIG. 1.
Figure 5:
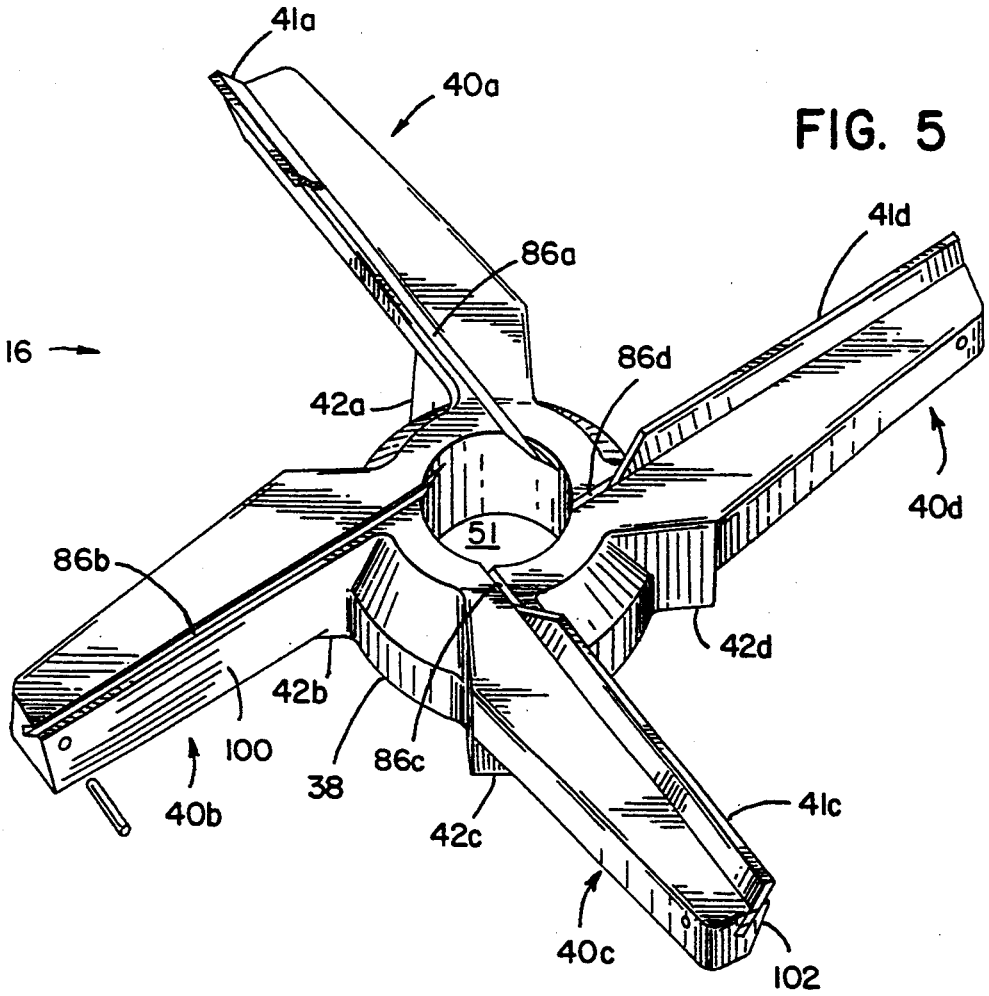
FIG. 5 is an isometric view of the knife holder assembly of FIG. 4.

Referring to FIGS. 1, 4, and 5, rotating knife assembly 16 comprises a knife holder consisting of a central hub portion 38 and a series of knife holding arms 40*a*, 40*b*, 40*c* and 40*d* extending outwardly therefrom. Knives 41*a*, 41*b*, 41*c* and 41*d* are mounted in arms 40*a*–40*d*, respectively. A series of drive lugs, shown at 42*a*, 42*b*, 42*c* and 42*d*, are formed integrally with hub portion 38 and are in alignment with the inner portion of each of arms 40*a*–40*d*, respectively. Referring to FIG. 1, lugs 42*a*–42*d* are adapted for placement in mating recesses, such as shown at 44*a* and 44*c*, formed in the end of feed screw 14. Engagement of drive lugs 42*a*–42*d* with the walls of the mating recesses, such as shown at 44*a*, 44*c*, causes rotation knife assembly 16 in response to rotation of feed screw 14.

A belleville-type spring washer assembly, such as shown at 46, is placed within an annular inner recess 48 formed in the end of feed screw 14 which extends inwardly from the mating recesses, such as 44*a*, 44*c*, also formed in the end of feed screw 14. Spring washer 46 bears between the ends of drive lugs 42*a*–42*d* and the inner end wall of annular recess 48 to bias knife assembly 16 against the inner surface of orifice plate 18.

A centering shaft 49 has its inner end located within a central bore 50 formed in the end of feed screw 14, and its outer end extending through a central passage 51 formed in hub portion 38 of knife assembly 16. A spring 49*a* is located in a bore formed in the inner end of shaft 49, and bears against the inner end of bore 50. The outermost end of centering shaft 49 is received within a central passage 52 provided in a bushing 53. Bushing 53 acts to maintain an adaptor 53*a* in position against the outer surface of orifice plate 18, and includes external threads 54 which engage internal threads 56 formed in a central opening 57 (FIG. 3) formed in orifice plate 18. With this arrangement, bushing 53 and orifice plate 18 cooperate to rotatably support the end of feed screw 14 through centering shaft 49. Centering shaft 49 is keyed to feed screw 14 by means of a key 57′ mounted to shaft 49 and engaged within a slot 57″ associated with bore 50. In this manner, shaft 49 rotates in response to rotation of feed screw 49.

Adaptor plate 53*a* is pinned to orifice plate 18 so as to be non-rotatable relative to orifice plate 18. As shown in FIG. 2, orifice plate 18 is provided with a pin-receiving hole 59, and adaptor plate 53*a* likewise is provided with a facing pin-receiving hole (not shown). A pin, or dowel, is placed within the facing pin-receiving holes in orifice plate 18 and adaptor plate 53*a* to fix adaptor plate 53*a* relative to orifice plate 18.

The mounting of knife assembly 16 to the end of feed screw 14 as shown and described provides adjustability of the clearance between the end of the tapered feed screw pressure flighting, shown at 58, and the inner surface of orifice plate 18 while maintaining the knives of knife assembly 16, such as shown at 41*a* and 41*c* in FIG. 1, against the inner surface of orifice plate 18. To increase the clearance between pressure flighting end 58 and the inner surface of plate 18, mounting ring 20 is turned on housing threads 22 so as to move ring 20 rightwardly. While this takes place, spring washer assembly 46 expands to urge knife assembly 16 rightwardly so as to maintain the knives against the inner surface of plate 18, and thereby maintaining the outer peripheral portion of plate 18 against lip 28 of mounting ring 20. If necessary, additional spring washers can be employed.

To decrease the clearance between pressure flighting end 58 and the inner surface of plate 18, mounting ring 20 is turned on housing threads 22 so as to move ring 20 leftwardly. This action forces spring assembly 46 to compress while maintaining the knives against the inner surface of orifice plate 18.

An annular space 61 (FIG. 1) is located outwardly of the ends of knife arms 40*a*–40*d*. Space 61 allows material to pass to a succeeding knife arm during rotation of knife assembly 16.

Referring to FIG. 4, the arrangement of knife holding arms 40*a*–40*d* relative to hub portion 38 is most clearly illustrated. As shown, arms 40*a*–40*d* are arranged so as to be non-radial relative to hub 38. More particularly, arms 40*a*–40*d* are positioned such that the longitudinal axis of each of arms 40*a*–40*d* is perpendicular to the longitudinal axis of its adjacent arms. In addition, the knives, such as shown at 41*a*, 41*c* and 41*d* as mounted to arms 40*a*, 40*c* and 40*d*, respectively, are also perpendicular to each other.

Arms 40*a*–40*d* each include a base portion such as shown at 62*a*–62*d*, respectively, which is mounted to hub portion 38. Arms 40*a*–40*d* further include outer end portions 64*a*–64*d*, respectively, spaced outwardly from base portions 62*a*–62*d*, respectively.

Knife assembly 16 is adapted for rotation in the direction of an arrow 64, when mounted to the end of feed screw 14.

Referring to arm 40*a* (FIG. 4), the orientation of arm 40*a* relative to a line 66*a* extending between the center of knife assembly 16 and the centroid of base portion 62*a* of arm 40*a* is such that arm 40*a* is oriented in the direction of arrow 64 away from line 66*a*. Each of arms 40*b*–40*d* is similarly oriented relative to lines 66*b*–66*d*, which extend through the center of knife assembly 16 and the centroid of the respective base portions 62*b*–62*d*. With this arrangement, the longitudinal axes of arms 40*a*–40*d* are tangential to a common circle concentric with the center of knife assembly 16.

With the forwardly disposed non-radial arrangement of arms 40*a*–40*d*, material located against the inner surface of orifice plate 18 and engaged by knife arms 40*a*–40*d* is generally swept inwardly toward the center of knife assembly 16 when it is rotated during operation of grinding head 10. A portion of such material may be swept outwardly upon rotation of knife assembly 16. Soft tissue is forced through grinding openings 30 before it reaches the central portion of plate 18. Hard material such as bone, sinew, gristle or the like, which does not readily pass through grinding openings 30, rides on plate 18 over openings 30 and is directed inwardly toward hub portion 38 of knife assembly 16 and the central area of plate 18. Upon continued rotation of knife assembly 16, the hard material is directed to ramped entryways 34 associated with collection openings 32, and is collected in openings 32. With a large piece of hard material which cannot pass into collection openings 32, the piece is lodged within entryway 34 into a collection opening 32 and is forced by knife assembly 16 against shearing surface 36 defined by the end of ramped entryway 34 in combination with the end area of collection opening 32. One of the knives (41*a*–41*d*) engages the piece of hard material, and cooperates with shearing surface 36 to cut the piece of material lodged within entryway 34. The portion of material within entryway 34 is then passed into collection opening 32, while the remainder of the piece of material is directed by the knife assembly into another of entryways 34. The above-described action repeats until the piece of material is reduced to a size small enough to pass in its entirety through one of collection openings 32.

It should be appreciated that knife arms 40*a*–40*d* may alternatively be arranged radially relative to hub portion 38, or arranged non-radially with arms 40*a*–40*d* being angled rearwardly. The specific arrangement of arms 40*a*–40*d* will be determined largely by the type and grade of material being ground. In any case, it has been found that hard material displays a tendency to migrate toward the center upon rotation of the knife assembly. This tendency simply increases when the knife arms are angled forwardly.

Referring to FIGS. 1, 4 and 5, knife assembly 16 includes pockets 68*a*, 68*b*, 68*c* and 68*d* formed in hub portion 38. Pockets 68*a*–68*d* are disposed forward of the forward edges of knife arms 40*a*–40*d*, respectively. Each of pockets 68*a*–68*d* is defined in part by an outwardly facing ramped surface 70*a*–70*d*, respectively. Referring to FIG. 1, the ramped surfaces, such as 70*a*, are located on hub portion 38 so as to intersect a longitudinal axis through each of collection openings 32. The ramped surfaces, such as 70*a*, cooperate with ramped entryways 34 into collection openings 32, to define a passage for directing hard material into ramped entryways 34 and collection openings 32. Pockets 68*a*–68*d* provide a low pressure toward the center of knife assembly 16, for facilitating passage of material inwardly toward the central portion of orifice plate 18 during rotation of knife assembly 16. In this manner, hard material which does not readily pass through grinding openings 30 is directed into ramped entryways 34 and collection openings 32.

Adaptor plate 53*a* is provided with a series of spaced passages therethrough, shown in FIG. 1 at 72*a* and 72*c*. The passages (72*a*, 72*c*) in adaptor plate 53*a* are placed into alignment with collection openings 32 in orifice plate 18, when adaptor plate 53*a* is pinned to plate 18 as described previously.

A collection cup 74 having a collection cavity 76 is mounted to adaptor plate 53*a* by internal threads 78 provided on collection cup 74 engaging external threads 80 formed on bushing 53. A discharge tube 82 extends from the outer end of cup 74, and includes an internal passage adapted to receive material from collection cavity 76. A valve 82 may be provided downstream of discharge tube 82 for controlling the pressure in tube 82 and the rate of discharge of hard material therefrom. Valve 83 is preferably adjustable so that an optimal pressure setting can be attained to ensure that substantially all hard material passes into collection openings 32 while a maximum amount of soft tissue passes through grinding openings 30 before being forced by knife assembly 16 into the central area of orifice plate 18. This pressure may also be controlled by adjusting the amount of engagement between collection cup internal threads 78 and adaptor plate threads 80, and thereby the amount of flow restriction provided by collection cavity 76.

A discharge auger 84 is mounted to the end of centering shaft 49 and is rotatable therewith in response to rotation of feed screw 14, for assisting in discharging the collected hard material from collection cavity 76 of cup 74 and into the internal passage of discharge tube 82. Discharge auger 84 is provided at its inner end with a non-circular hub 84', and a threaded stub shaft extends from hub 84' into engagement with internal threads provided in a bore 85 formed in the outer end of centering shaft 49. A frustoconical collar member 85' is mounted to the end of centering shaft 49 along with discharge auger 84, and is rotatable therewith by engagement of auger hub 84' with the walls of an internal passage formed in collar member 85' in which hub 84' is located. In this manner, collar member 85' is rotatable along with discharge auger 84 in response to rotation of feed screw 14.

The outer walls of collar member 85' are oriented substantially parallel to the inner walls of collection cup 74, so that a tapered annular passageway is formed in collection cavity 76 through which the collected hard material passes into the internal passage of discharge tube 82. Discharge auger 84 assists in moving the collected hard material into and through the internal passage of discharge tube 82, to reduce the back pressure within collection cavity 76 and to facilitate passage of collected hard material through collection openings 32 and the passages, such as **72*a*, 72*c*, formed in adaptor plate 53*a* and into collection cavity 76**.

Reference is now made to FIGS. 1 and 5–7 for an explanation of the manner in which knives **41*a*–41*d* are mounted to knife arms 40*a*–40*d*, respectively. As shown in FIG. 5, arms 40*a*–40*d* are provided with knife mounting slots 86*a*–86*d*, respectively. Each of slots 86*a*–86*d* extends throughout the length of its respective knife arm, and opens into central passage 51 provided in hub portion 38 of knife assembly 16. Slots 86*a*–86*d* are slanted relative to the outer faces of knife arms 40*a*–40*d*, respectively, to provide a forward angled orientation of knives 41*a*–41*d* relative to the outer faces of knife arms 40*a*–40*d***, respectively.

Figure 7:
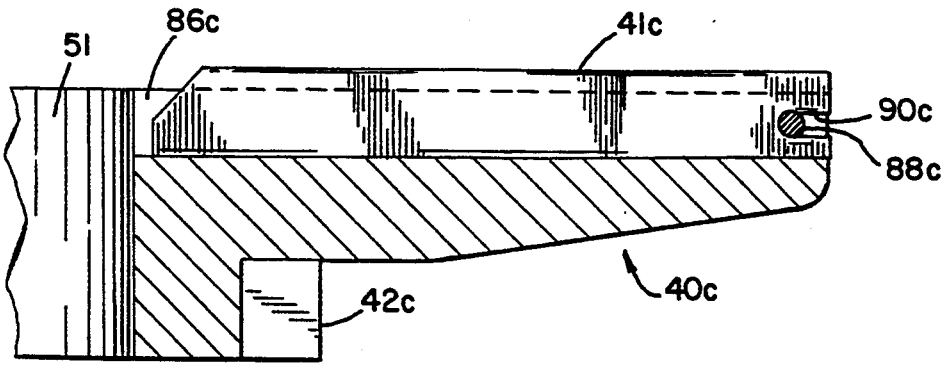
FIG. 7 is a view similar to FIG. 6, showing mounting of a knife in the knife holder assembly of the invention.

Referring to FIG. 7, knife arm **40*c* and knife 41*c* are illustrated. A knife mounting pin 88*c* is provided toward the outer end of knife arm 40*c*, extending transversely through knife mounting slot 86*c*. Knife mounting pin 88*c* is pressed-fit into a transverse opening formed in the outer end of knife arm 40*c*. Knife 41*c* includes an outwardly facing knife mounting slot 90*c* formed in its outer end. Knife 41*c* is mounted to knife arm 40*c* by first inserting the length of knife 41*c* into slot 86*c* so that the outer end of knife 41*c* clears knife mounting pin 88*c*. In this position, a portion of the inner end of knife 41*c* is disposed within passage 54 formed in hub portion 38. Knife 41*c* is then slid rightwardly within knife mounting slot 86*c*, so that pin-receiving slot 90*c* in its outer end receives knife mounting pin 88*c* and pin 88*c* engages the inner end of pin-receiving slot 90*c*. After centering shaft 49 is inserted through passage 51 formed in hub portion 38, leftward movement of knife 41*c* within knife mounting slot 86*c* results in the leftward end of knife 41*c* engaging centering shaft 49 before knife mounting pin 88*c* exits pin-receiving slot 90*c*. In this manner, knife 41*c* is positively retained within knife mounting slot 86*c* of knife arm 40*c***.

Knives **41*a*, 41*b* and 41*d* are retained in knife mounting slot 86*a*, 86*b* and 86*d*, respectively of knife arms 40*a*, 40*b* and 40*d*** in a similar manner.

Figure 6:
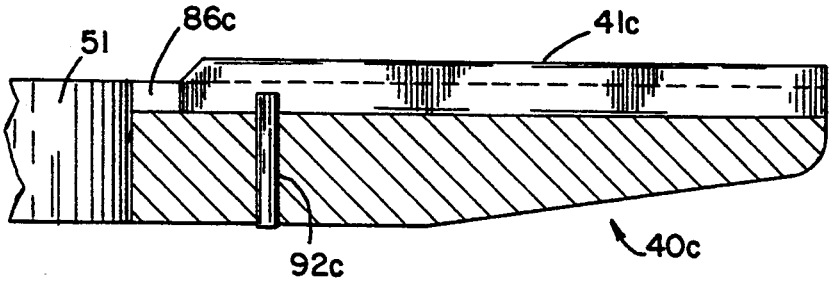
FIG. 6 PRIOR ART
FIG. 6 is a partial sectional view showing prior art mounting of knives in a prior art knife holder assembly.

FIG. 6 illustrates a prior art system of mounting a knife within a knife arm. Like reference characters will be used where possible to facilitate clarity. In the arrangement shown in FIG. 6, knife arm **40*c* again includes a knife mounting slot 86*c* which extends throughout the length of knife arm 40*c* between its outer end and inwardly opening into passage 51. A knife mounting pin 92*c* is press-fit into an opening formed in the rearward portion of knife arm 40*c*, with its forward edge extending into knife mounting slot 86*c*. Knife 41*c* is provided with a notch 94 which receives the end of pin 92*c*. With this arrangement, knife 41*c* is not positively retained within knife mounting slot 86*c*. Rather, pin 92*c* and notch 94 simply cooperate to fix to lateral position of knife 41*c* relative to knife arm 40*c*. With the knife mounting arrangement as illustrated in FIG. 7, providing positive retention of the knives within the knife mounting slots formed in the knife arms, changing of orifice plates is accomplished in a quicker and more efficient manner, in that the operator does not have to be concerned with making sure the knives do not fall out of the knife mounting slots formed in the knife arms. As long as centering shaft 49 remains in place in passage 51 formed in hub portion 38 of knife assembly 16**, the knives are positively retained and cannot be removed from the knife mounting slots.

Referring to FIGS. 4 and 5, the forward face of knife area **40*b* is provided with a forwardly extending ramped surface, shown at 100. While not visible in FIGS. 4 and 5, the forward face of knife arm 40*d* is similarly provided with a forwardly extending ramped surface. As shown in FIG. 5, the forward face of knife arm 40*c* is provided with a rearwardly extending ramped surface 102. Knife arm 40*a*, which is opposite knife arm 40*c***, is similarly provided with a rearwardly extending ramped surface.

When rotating knife assembly 16 is mounted to the end of feed screw 14, knife arms **40*a* and 40*c* are located adjacent the termination of the pressure flights, such as shown in phantom in FIG. 4 at 103*a* and 103*c*, at the end of feed screw 14. Accordingly, arms 40*b* and 40*d* are located at 90° to the pressure flight terminations 103*a*, 103*c*. With this arrangement, the rearwardly (or inwardly) extending ramped surfaces on knife arms 40*a* and 40*d* act to relieve some of the pressure generated by the pressure flight terminations 103*a*, 103*c* during rotation of feed screw 14. The forwardly (or outwardly) extending ramped surfaces, such as surface 100 on the forward face of arm 40*b*, act to generate pressure forcing the material toward the inner surface of orifice plate 18 at arms 40*b*, 40*d* during rotation of feed screw 14. In this manner, the pressure forcing the material toward orifice plate 18 is more evenly distributed between arms 40*a*, 40*d***.

Gaps, such as shown at **104*a* and 104*c* in FIG. 4, are present between pressure flight terminations 103*a*, 103*c* and the forward faces of knife arms 40*a*, 40*c*, respectively. Gaps 104*a*, 104*c* lead to passages, such as shown at 105*a*, 105*c* in FIG. 1, formed between the inner surfaces of the knife arms and the end of feed screw 14. The gaps, such as 104*a* and 104*c*, and the passages, such as 105*a* and 105*c*, cooperate to allow hard material to pass rearwardly from one knife arm to the next during rotation of the knife assembly. This provides further insurance that hard material is not excessively forced against the inner surface of orifice plate 18 before it reaches collection openings 32**.

Figure 8:
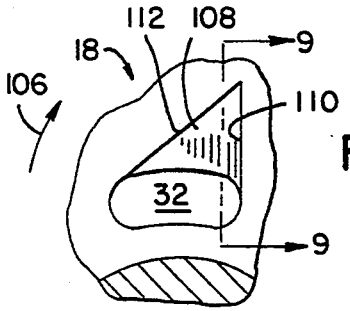
FIG. 8 is an enlarged partial elevation view showing an alternate embodiment for the ramped entryways associated with the collection openings formed in the orifice plate.
Figure 9:
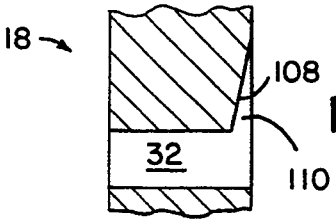
FIG. 9 is a partial sectional view taken generally along line 9—9 of FIG. 8.

FIGS. 8 and 9 illustrate an alternate arrangement for the ramped surfaces leading into collection openings 32 formed in orifice plate 18. In this arrangement, the knife assembly rotates in the direction of an arrow 106. The ramped surface leading into collection opening 32 is shown at 108. Ramped surface 108 extends outwardly toward the outer grinding orifices 30 formed in orifice plate 18, tapering upwardly and outwardly from collection opening 32. Ramped surface 108 terminates at its rightward end in a shearing edge 110, which is substantially triangular in shape. Ramped surface 108 intersects the inner surface of orifice plate 18 at a line shown at 112, which extends between the outer end of shearing edge 110 and the leftward end of collection opening 32. This arrangement acts to force the hard material downwardly on ramped surface 108 toward collection opening 32 and shearing edge 110, so that a maximum amount of area of shearing edge 110 is available for acting on the hard material along with the knives to shear the hard material off and to facilitate its passage into collection openings 32. Ramped surface 108 is substantially in the form of a right triangle defined between shearing edge 110, the outer wall of collection opening 32, and line of intersection 112.

Ramped surface 108 has a depth of approximately $\frac{1}{8}$ inch at the outer wall of collection opening 32, and is inclined relative to the inner surface of orifice plate 18 at an angle of approximately 8.5°.

With some types of material being ground, a situation sometimes arises in which a substantial amount of usable soft tissue passes through collection openings 32 along with the hard material. In such situations, it is desirable to recover the usable soft material in order to reduce the amount of wasted usable material. FIGS. 10–13 illustrate two arrangements for recovering usable material which passes through collection openings 32.

Figure 10:
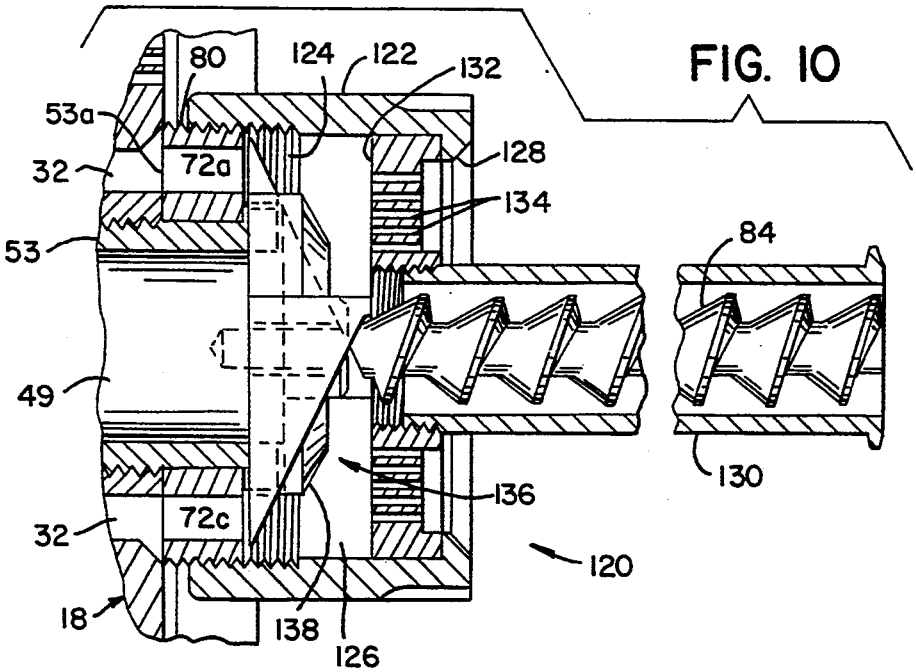
FIG. 10 is a partial sectional view showing one embodiment of a recovery grinder arrangement for grinding of soft material which passes through the collection openings formed in the orifice plate.

Referring to FIG. 10, a recovery grinding arrangement 120 generally includes a cylindrical housing member 122 having internal threads 124 for engaging external threads 80 provided on adaptor plate 53*a*. Housing 122 defines an internal collection cavity 126, and an opening 128 is provided at the outer end of housing member 122.

In the same manner as described previously with respect to FIG. 1, a discharge auger 84 is mounted to the end of centering pin 49 and is rotatable therewith in response to rotation of feed screw 14. Discharge auger 84 is located within a discharge passage formed in a discharge tube 130, which is threadedly engaged with a central passage formed in a secondary orifice plate, shown at 132. As with orifice plate 18, secondary orifice plate 132 is provided with a series of discharge orifices 134, which may be somewhat smaller in diameter than orifices 30 formed in primary orifice plate 18.

Secondary orifice plate 132 engages an inwardly extending lip which forms opening 128 in the outer end of housing 122.

Figure 11:
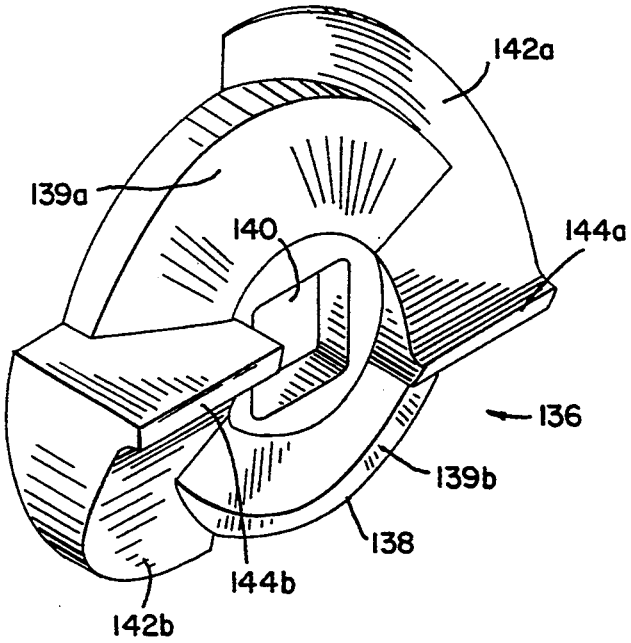
FIG. 11 is an isometric view showing the rotating recovery knife assembly provided in the recovery grinding arrangement of FIG. 10.

A recovery knife assembly 136, shown in FIGS. 10 and 11, is located between the end of centering shaft 49 and the inner surface of secondary orifice plate 132. Recovery knife assembly 136 generally comprises a disk-like body portion 138 having a square aperture 140 formed therein. The hub of discharge auger 84 is placed within aperture 140, so that recovery knife assembly 136 is rotatable in response to rotation of centering shaft 49 and feed screw 14. Body portion 138 includes a pair of beveled surfaces 139*a*, 139*b*.

Spring 49*a* (FIG. 1) urges recovery knife assembly 136 against the inner surface of secondary orifice plate 132.

Recovery knife assembly 136 further includes a pair of angled flights 142*a*, 142*b*, which terminate in a pair of knife tips 144*a*, 144*b*, respectively. Material passing through the passages, such as 72*a*, 72*c*, formed in adaptor plate 53*a*, is picked up by flights 142*a*, 142*b* and fed thereon toward knife tips 144*a*, 144*b* and toward the inner surface of secondary orifice plate 132. The hard material migrates along beveled surfaces 139*a*, 139*b* toward the center of recovery knife assembly 136 and into the inlet of the internal passage provided in discharge tube 130. The soft material migrates outwardly toward orifices 134 formed in orifice plate 132, and is forced therethrough by pressure generated by flights 142*a*, 142*b* upon rotation of recover knife assembly 136.

The ground soft material which is discharged through orifices 134 in secondary orifice plate 132 mixes with the ground soft material discharged from the orifices formed in primary orifice plate 18, and thereby is incorporated into the final ground product.

As in the embodiment of FIG. 1, discharge auger 84 acts to move the collected hard material through the passage of discharge tube 130, for ultimate collection in a receptacle (not shown). A valve, such as 83 in FIG. 1, may be provided downstream of the discharge of discharge tube 130 for regulating the amount of pressure within discharge tube 130 and collection cavity 126. In this manner, an optimal operating condition can be attained so as to recover a maximum amount of soft material through secondary orifice plate 132 while removing substantially all hard material from the final ground product.

Figure 12:
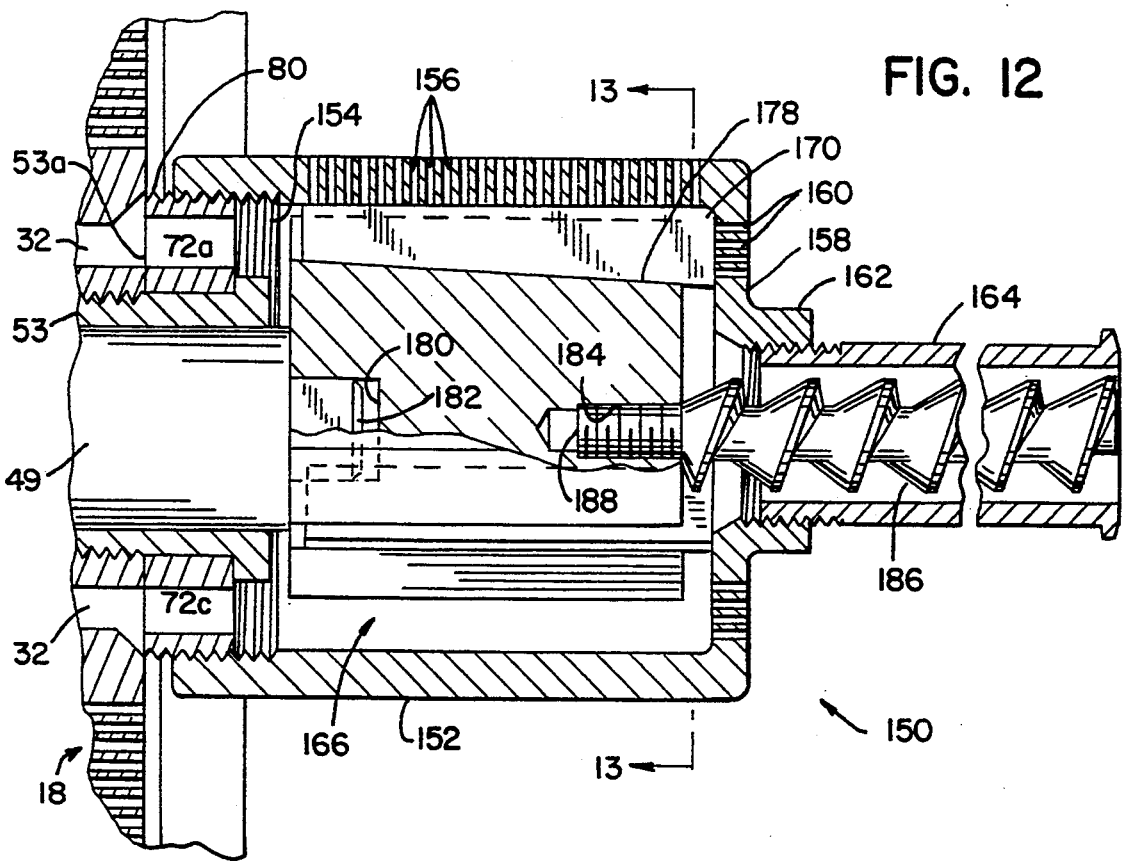
FIG. 12 is a view similar to FIG. 10, showing an alternative embodiment for providing recovery/grinding of soft material.
Figure 13:
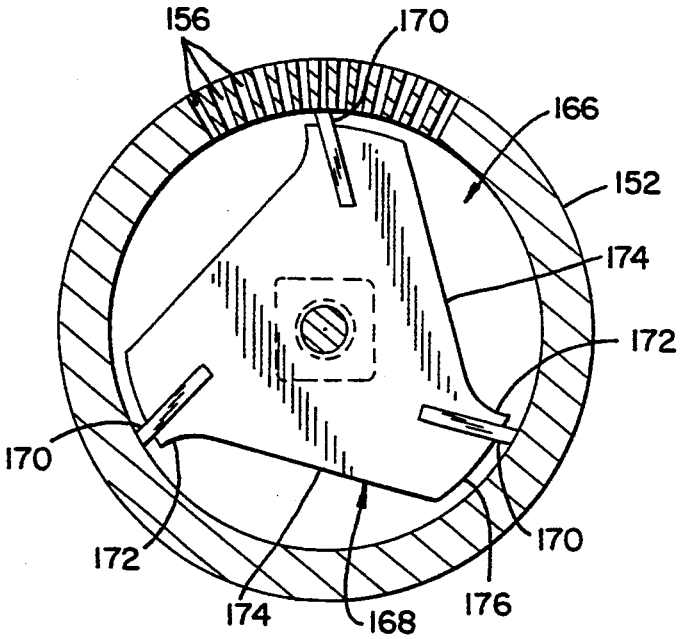
FIG. 13 is a sectional view taken generally along line 13—13 of FIG. 12.

FIG. 12 illustrates a recovery grinding arrangement 150. In this arrangement, a cylindrical housing 152 is provided with internal threads 154 which engage external threads 80 on adaptor plate 53*a*. Housing 152 is provided with a series of relatively small upwardly facing orifices 156 extending through the upper portion of its side wall. Orifices 156 are formed in the wall of housing 152 throughout an arc ranging between 60° and 120°. As shown in FIG. 13, the arc encompassing orifices 156 is approximately 60°. Housing 152 includes an end wall 158 which partially closes its end opposite the open end in which internal threads 154 are formed. An annular ring of relatively small orifices 160 is formed in end wall 158. An internally threaded nipple 162 is provided in end wall 158, and a discharge tube 164 having external threads at one of its ends is adapted for connection to nipple 162. With this arrangement, the internal discharge passage of discharge tube 164 is placed into communication with the interior of cylindrical housing 152.

A rotating recovery knife assembly 166 is disposed within the interior of housing 152. Knife assembly 166 includes a knife holding member 168 having three equally radially spaced axially extending lobes provided with outwardly facing slots in which knives 170 are mounted. Each lobe is formed by a substantially radial front surface 172 which merges into a leading surface 174 in a direction toward the preceding lobe. Each lobe further includes an outer surface 176 located inwardly of the inner wall of housing 152, and extending between the front surface 172 and the leading surface 174 of the succeeding lobe.

The slot formed in each lobe angles inwardly toward the center of knife holding member 168 in a direction toward end wall 158, such as illustrated by slot 178 in FIG. 12. Each knife 170 is provided with an inner surface having an angle adapted to mate with the angled inner surface of the slots, so as to maintain the outer edge of each knife 170 in contact with the inner surface of housing 152 throughout the length of knife 170. In addition, knives 170 have a height at their outer ends which extends throughout the thickness of the annular ting of orifices 160 formed in end wall 158. The end of knives 170 is in contact with the inner surface of end wall 158 throughout the width of the ring of orifices 160.

As in the FIG. 10 embodiment, spring 49*a* (FIG. 1) urges recovery knife assembly 166 against end wall 158 of housing 152.

Knife holding member 168 is provided at its inner end with a square recess 180 facing the outer end of centering shaft 49. Centering shaft 49 is provided with a square projection 182 which mates with the side walls of square recess 180, so as to impart rotation to knife holding member 168 in response to rotation of centering shaft 49 caused by rotation of feed screw 14.

The outer end of knife holding member 168 is provided with an internally threaded bore 184. A discharge auger 186 has an externally threaded stub shaft 188, which is engagable with threaded bore 184 to secure discharge auger 186 to knife holding member 168. With this arrangement, rotation of knife holding member 168 causes rotation of discharge auger 186, to advance hard material through the discharge passage of discharge tube 164.

In operation, the embodiment of FIG. 12 functions as follows. In a manner as described above, hard material is routed through collection openings 32 in orifice plate 18 to the discharge passages in adaptor plate 53*a*, such as shown at 72*a* and 72*c*, and into the interior of cylindrical housing 152. A certain amount of usable soft material is included with the hard material, and the soft material migrates outwardly toward the inner wall of housing 152, while the hard material migrates inwardly. The usable soft material is forced upwardly through orifices 156 in housing 152, and is severed by knives 170. In a similar manner, the soft material is forced outwardly through the ring of orifices 160 formed in end wall 158, and is severed by the ends of knives 170. The discharged soft material passing through orifices 156 and 160 is mixed with the ground soft material discharged from the upper portion of primary orifice plate 18, flowing downwardly along the sides of housing 152 into a hopper or the like. The hard material is routed along leading surfaces 174 of knife holding member 168 toward its outer end, and from there passes into the opening of nipple 162 and the discharge passage of discharge tube 164. Discharge auger 186 moves the hard material through discharge tube 164, thus creating a low pressure area at the entrance into nipple 162 to facilitate drawing the hard material thereinto.

In an alternate embodiment, the annular ring of small orifices 160 formed in end wall 158 can be eliminated, thus providing only radial upward flow of the recovered material through orifices 156 formed in housing 152.

While the invention as shown and described provides several features which enhance the ability of grinding head 10 to collect hard material during operation, it is understood that certain of the described features could be employed without other of the described features to yield improved hard material collection. For example, an orifice plate 18 constructed according to the invention could be employed with a prior art knife assembly, and would result in improved ability to collect hard material due to the advantages offered by ramped entryways 34 leading into collection openings 32. Knife assembly 16 as shown and described could be employed with a prior art orifice plate which does not include ramped entryways, and would result in improved hard material collection due to advantages in directing material inwardly offered by the construction of knife assembly 16. Recovery grinding arrangement 120 and 150 could be employed with a prior art grinding and hard material collection system, to provide recovery grinding of usable soft material which is collected along with the hard material. To most effectively collect hard material and recover usable material, however, the features as described are combined into a single structure.

The adjustability feature described previously, in which the clearance provided between the inner surface of orifice plate 18 and the end 58 of the pressure righting, allows the operator to adjust grinding head 10 according to the hard material conditions in the meat being ground. For a lower grade of meat, which may contain large pieces of hard material, the clearance between the inner surface of orifice plate 18 and pressure righting end 54 is increased. This allows the large pieces of material to ride on the inner surface of orifice plate 18 without being repeatedly subjected to pressure exerted by pressure righting end 54, which otherwise may cause the piece of material to chip against grinding orifices 30. In this manner, the large piece of material is directed inwardly toward collection orifices 32 without being repeatedly subjected to exertion of pressure, and is reduced in size as described previously for ultimate passage through collection openings 32. When a higher grade of meat is being ground, and which contains smaller pieces of hard material, the clearance between the inner surface of orifice plate 18 and pressure flighting end 54 is decreased. In all situations, however, knife assembly 16 is urged against the inner surface of orifice plate 18 by spring washer assembly 46.

Figure 14:
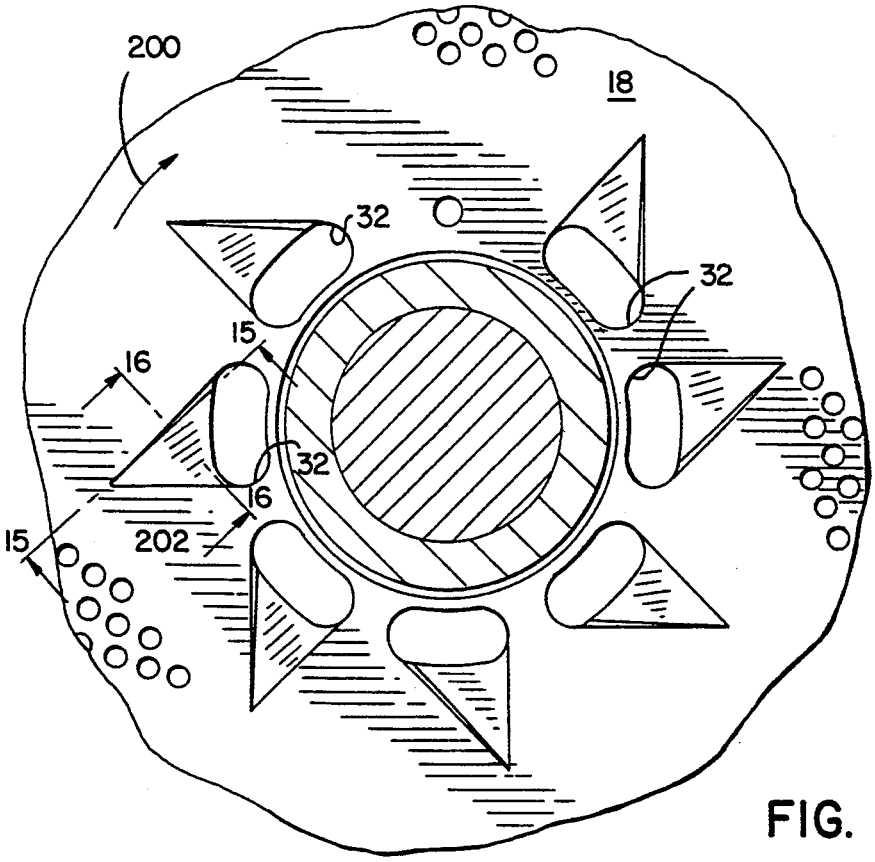
FIG. 14 is a view similar to FIG. 2, showing an alternate embodiment for the ramped entryways associated with the collection openings formed in the orifice plate.
Figure 15:
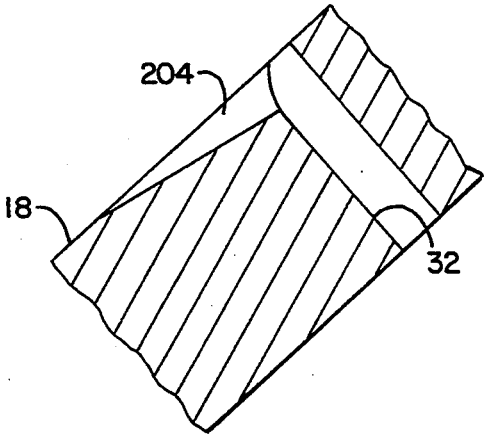
FIG. 15 is a partial sectional view taken along line 15—15 of FIG. 14.
Figure 16:
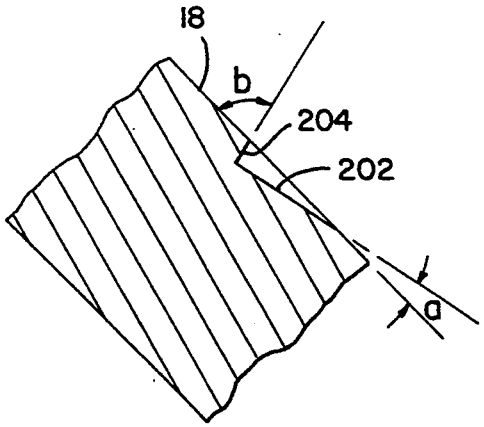
FIG. 16 is a partial sectional view taken along line 16—16 of FIG. 14.

FIGS. 14–16 illustrate an alternative embodiment for the ramped entryways leading into collection openings 32, somewhat similar to the embodiment shown in FIG. 8. In the embodiment of FIG. 14, the knife assembly rotates in the direction of arrow 200. Each ramped entryway includes a ramped surface 202 which intersects the surface of orifice plate 18 and increases in depth in the direction of arrow 200. The line of intersection between ramped surface 202 and the surface of orifice plate 18 extends perpendicular to the major axis of collection opening 32, and extends tangentially from the arcuate end of collection opening 32.

An end wall 204 extends between the lowermost end of ramped surface 202 and the surface of orifice plate 18. The line of intersection between the surface of orifice plate 18 and end wall 204 extends from the outermost point defined by the intersection of ramped surface 202 with the surface of orifice plate 18 tangentially to the other arcuate end of collection opening 32. This orientation of end wall 204 acts to direct material toward the downstream end of collection opening 32 and the shearing edge defined thereby in combination with the surface of orifice plate 18, to shear the hard material as the rotating knife assembly passes over the downstream ends of collection openings 32.

Illustratively, ramped surface 202 at its intersection with the outer edge of collection opening 32 is disposed at an angle a (FIG. 16) of approximately 11.7°, tapering upwardly in an outward direction toward the outermost point defined by ramped surface 202, where it merges with the surface of orifice plate 18. End wall 204 is oriented at an angle of 90° to ramped surface 202, so that the angle b (FIG. 16) between the surface of orifice plate 18 and end wall 204 is approximately 78.3°.

FIG. 17 illustrates a hard material discharge system, shown generally at 210, for controlling the output of hard material from the spaced passages, such as *72a, 72c,* formed in adaptor plate *53a.* Hard material discharge system 210 includes a cup member 212 having internal threads which engage external threads *34a* formed on adaptor plate *53a.*

Cup member 212 includes internal walls defining a collection cavity 214. Cavity 214 is defined by an upstream straight wall section 216, and a downstream tapered wall section 218 which is frustoconical in longitudinal cross section. Cup member 212 further defines an annular passage 219 in its outer end, which extends outwardly from cavity 214.

An adaptor member 220 is mounted to a flange *220a* defined by the outer end of cup member 212. Adaptor member 220 includes a mounting flange 221 engagable with cup member flange *220a,* an internal passage 222, and a tapered annular wall 223 which defines the entrance into passage 222 at the upstream end of adaptor member 220.

Adaptor member 220 is secured to cup member *220a* flange in any satisfactory manner. For example, a conventional clamp may be employed to secure adaptor member flange 221 to the cup member flange *220a,* or external threads can be formed on cup member flange *220a,* and an internally threaded clamping ring threaded onto the external threads of the cup member flange. A resilient 20A durometer urethane gasket or washer *221a* is disposed between adaptor member flange 221 and cup member flange *220a.* A flexible tigon tube is adapted to be connected to the outer end of adaptor member 220 for conveying hard material discharged from adaptor member 220 to a satisfactory receptacle or the like. Resilient washer *221a* accommodates any misalignment between discharge auger 224 and discharge passage 222 of adaptor member 220. As set forth above, discharge auger 224 is mounted to the end of feed screw centering pin 49, while cup member 212 and adaptor member 220 are mounted to orifice plate 18 through adaptor plate *53a.* Centering pin 49 is subjected to wear during operation and resilient washer *221a* is compressible to accommodate resulting misalignment between discharge auger 224 and adaptor member passage 222.

As in the previous embodiments, a discharge auger 224 is mounted to the end of feed screw centering shaft 49, and is rotatable therewith in response to rotation of feed screw 14. Discharge auger 224 acts to move material located within cavity 214 in a leftward-to-rightward direction through cavity 214. Discharge auger extends throughout the length of cavity 214, through passage 219 formed in the outer end of cup member 212, and into and partially through adaptor member passage 222.

Figure 19:
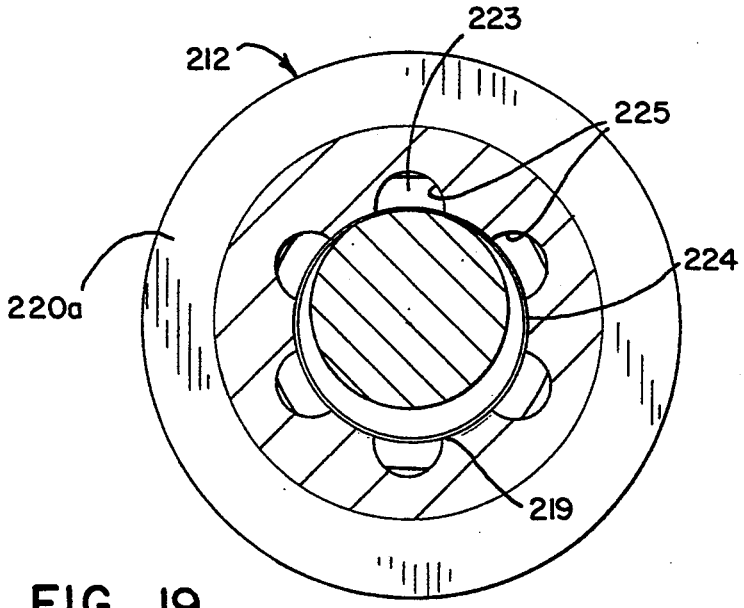
FIG. 19 is a section view taken along line 19—19 of FIG. 17.

Referring to FIG. 19, a series of spaced, axial semicircular flutes 225 are formed in the outer end of collection cup 212. Flutes 225 define axial grooves in the internal wall which defines collection cup passage 219, extending longitudinally throughout the length of passage 219 and opening into collection cavity 214.

Referring to FIGS. 17–19, in an illustrative application in which orifice plate 18 is a conventional 11 inch diameter plate having a large number of 5/64" or ⅛" orifices therethrough, secondary discharge auger 224 extends 6 inches from the end of centering pin 49 and has an outside diameter of 0.865", and provides flighting which has a pitch of 0.5 inches and a depth of 0.125 inches. Adaptor member 220 has a length of approximately 4.25 inches, and secondary discharge auger 223 extends approximately 4/5ths of the length of adaptor member 220 terminating approximately one inch short of its outer end. Passage 219 formed in the outer end of cup member 212 defines an internal diameter of 1.00 inches, and flutes 225 have a depth of approximately 0.1875 inches. Adaptor member passage 222 defines an internal diameter of 0.875 inches, providing a very close tolerance between the outside diameter of discharge auger 224 and the internal wall defining passage 222.

The arrangement FIG. 17 essentially provides a rotating path between discharge auger 224 and the internal wall of passage 222, defined by the flighting of discharge auger 224, for moving hard material through adaptor member passage 222 upon rotation of secondary discharge auger 224. Back pressure is provided in collection cavity 214 to allow primarily only hard material to pass through the passages, such as *72a, 72c* in adaptor plate *53a* and into collection cavity 214. A minimal amount of usable soft material is .passed through adaptor member passage 222 upon rotation of secondary discharge auger 224.

In operation, when hard material within collection cavity 214 reaches passage 219 and flutes 225, the material is forced along the length of passage 219 and flutes 225 by rotation of discharge auger 224. At the same time, discharge auger 224 acts in cooperation with flutes 225 to shear the hard material and thereby reduce it in size. In addition, flutes 225 keep the hard material from spinning, providing an axial passageway in combination with passage 219 to force the hard material rightwardly toward tapered entryway 223 and adaptor member passage 222.

The flow rate of hard material discharged from collection cavity 214 can be calibrated by varying the diameter of discharge auger 224 and the pitch and depth of its flighting, along with the diameter of adaptor member passage 222, in order to attain an optimum back pressure in collection cavity 214 to maximize discharge of hard material and minimize discharge of soft material. For example, when an orifice plate 18 having larger orifices is used, discharge auger 224 is removed and replaced with a discharge auger with righting having a greater pitch and/or depth, to increase the flow rate of hard material from collection cavity 214 and into and through adaptor member passage 222. This prevents excessive back pressure from building up within collection cavity 214, which may otherwise result in hard material passing through the orifices formed in orifice plate 18.

In some instances, when the flow rate of hard material through adaptor member passage 222 is increased, it has been found that an increased amount of soft material, typically in the form of fat, is discharged through passage 219 and adaptor member passage 222 upon rotation of discharge auger 224. When this occurs, adaptor member 220 is removed and replaced with an adaptor member 226 (FIG. 20). Adaptor member 226 includes a large number of relatively small orifices 227, essentially defining a tubular screen throughout a portion of the length of adaptor member 226. Illustratively, each of orifices 227 may have a diameter of 0.0761 inches, formed in 24 staggered rows having 15 holes per row located at 15° increments around the outside diameter of adaptor member 226. The length of the rows of orifices 227 may be approximately 1.942 inches. With this structure, it has been found that hard material is maintained within the flights of the discharge auger, and soft material is squeezed out through openings 227. The soft material discharged through openings 227 can be collected in a receptacle bolted onto cup member 212, or it can be rerouted back into the grinder chamber for mixing with the meat being ground.

Figure 21:
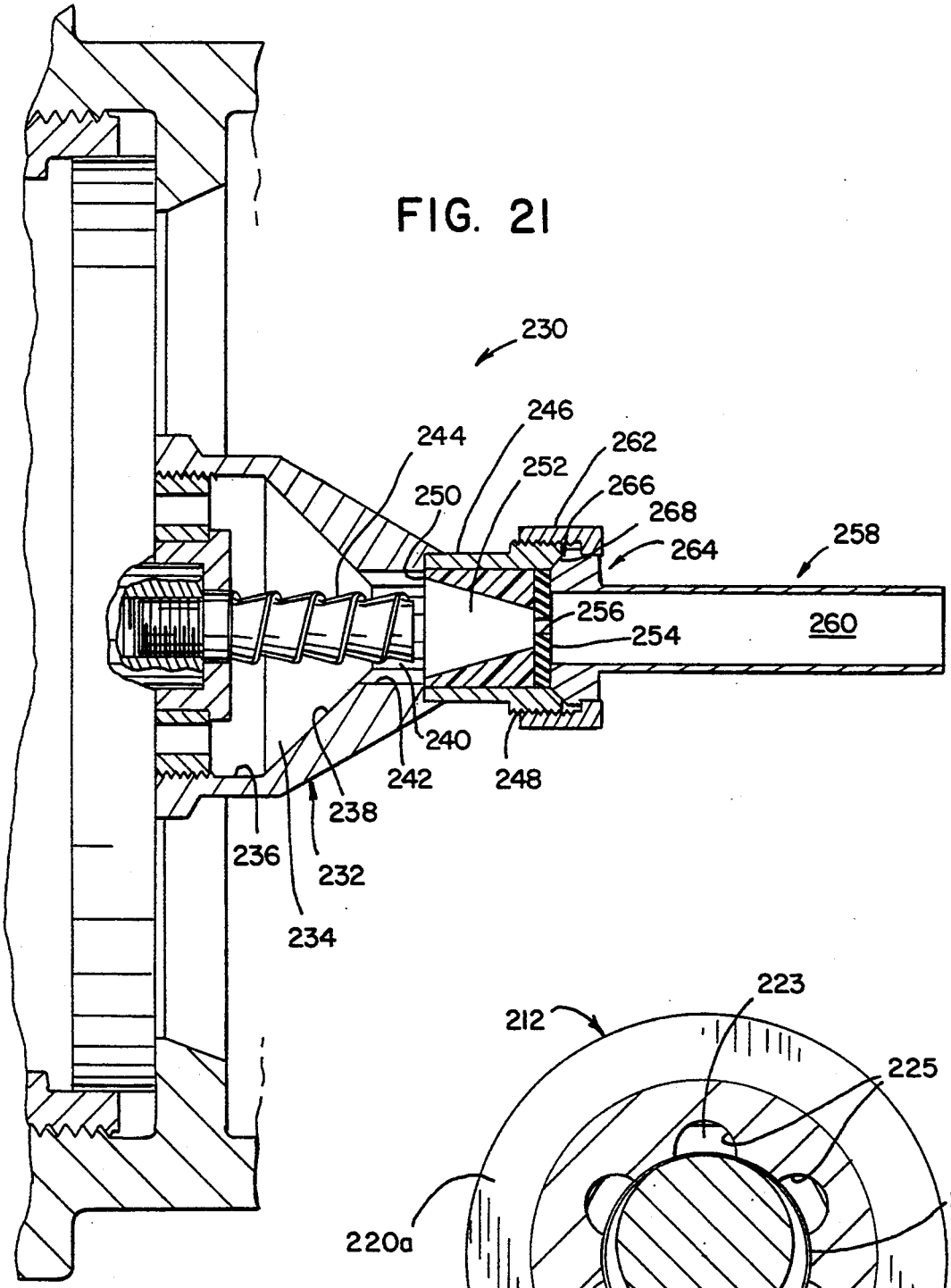
FIG. 21 is a partial cross-sectional view showing another alternate hard material discharge system constructed according to the invention.

FIG. 21 illustrates yet another hard material discharge system, shown generally at 230, for controlling the output of hard material from the spaced passages, such as 72*a*, 72*c*, formed in adaptor plate 53*a*. Hard material discharge system 230 includes a cup member 232 having internal threads which engage external threads 34*a* formed on adaptor plate 53*a*.

Cup member 232 is generally formed similarly to cup member 212 shown in FIG. 20, defining an internal collection cavity 234 having an upstream straight wall section 236 and a downstream tapered wall section 238. Cup member 232 further defines an annular passage 240 in its outer end, which extends outwardly from collection cavity 234. A series of flutes 242 are provided in passage 240, similarly to flutes 225 formed in passage 219 of collection cup 212 (FIG. 17).

In this embodiment, a discharge auger 244 extends partially through passage 240, with its outer end being located upstream of the end of passage 240 and flutes 242.

A sleeve 246 is mounted to the outer end of collection cup 232, such as by welding or the like. Sleeve 246 is substantially cylindrical, and includes a series of external threads 248, located at its outer end. An insert 250 is located within the interior of sleeve 246. Insert 250 is constructed of a plastic or nylon material, and includes a tapered axial passage 252 extending throughout its length. Passage 252 provides an inlet at its upstream end in communication with passage 240 and flutes 242, and tapers inwardly in a left-to-right direction, terminating in an outlet at the downstream end of insert 250.

A flexible resilient diaphragm 254 is positioned in the interior of sleeve 246 at the outlet of passage 252, such that the upstream face of diaphragm 254 abuts the downstream end of insert 250. Diaphragm 254 is constructed of a resilient material such as urethane. A central aperture 256 extends through diaphragm 254, and is in communication with the outlet of passage 252.

A discharge adaptor or tube 258, defining a discharge passage 260, is secured to sleeve 246 by means of a retaining ting 262. Retaining ring 262 engages a shoulder formed on a mounting portion 264 which is integral with discharge tube 258. Mounting portion 264 further includes a tapered seating surface 266, which is engagable with a mating tapered seating surface 268 defined by the outer end of sleeve 246. With this arrangement, insert 250 and diaphragm 254 are secured within collar 246 by first inserting discharge tube 258 through retaining ring 262, and then threading ting 262 onto external threads 248 provided on sleeve 246 until engagement of seating surfaces 266, 268. The upstream end of insert 250 abuts the end wall defined by cup member 232 onto which passage 240 and flutes 242 open, and diaphragm 254 is sandwiched between the downstream end of insert 250 and the upstream end of discharge tube 258. Diaphragm 254 and insert 250 can be changed simply by removing retaining ring 262 and positioning a new insert and diaphragm within sleeve 246 in the same manner as described above.

In operation, hard material discharge system 230 functions as follows. Hard material is forced through the passages, such as 72*a*, 72*c* formed in adaptor plate 53*a* upon rotation of the knife assembly, in the same manner as described previously, and discharged into the portion of collection cavity 234 defined by inner wall 236. Continued supply of hard material through the adaptor plate passages, such as 72*a*, 72*c*, results in leftward-to-rightward movement of the hard material through collection cavity 234 along tapered wall 238 defining the downstream portion of collection cavity 234. While the knife assembly is rotating, discharge auger 244 rotates simultaneously, to assist in the leftward-to-rightward movement of the hard material through collection cavity 234. The hard material is forced through passage 240 and flutes 242, which act to shear the hard material to reduce it in size. From passage 240 and flutes 242, the hard material enters the inlet of insert passage 252, and is forced therethrough by pressure toward the outlet of insert passage 252 and diaphragm aperture 256. When particles of hard material which are smaller than aperture 256 arrive at the outlet of insert passage 252, such particles are forced through diaphragm passage 256 simply due to back pressure within passage 252. When particles of hard material larger than aperture 256 arrive at the outlet of insert passage 252, such particles lodge within and block diaphragm aperture 256 until sufficient back pressure is developed within passage 252 to force diaphragm 254 to flex rightwardly, resulting in aperture 256 expanding a sufficient amount to allow the hard material particles to pass therethrough. Diaphragm 254 then returns, at least partially, to its flexed condition to once again reduce the size of aperture 256. Tapered insert passage 252, in combination with diaphragm 254, act to provide a restriction in the flow of hard material through hard material discharge system 230 and into passage 260 of discharge tube 258.

The construction of hard material discharge system 230 allows an operator to vary the amount of restriction provided by insert 250 and the amount of back pressure required to discharge a particle of hard material through diaphragm aperture 256, simply by providing different configurations of the passage through insert 250 and varying the thickness of diaphragm 254. These variables can be adjusted according to the amount of hard material present in the meat being ground and the size of the orifices in orifice plate 18 to increase or decrease the flow rate of hard material into discharge passage 260.

It has been found that providing such a restriction in the hard material discharge system, such as in systems 210, 230, substantially increases the pressure within collection cavity, such as 214, 234. Notwithstanding this increase in pressure, the hard material collected upon rotation of the knife assembly and forced toward the center of orifice plate 18 continues to be supplied through orifice plate collection openings 32, and through the adaptor plate passages, such as 72*a*, 72*c*. It has further been found that, when a particle of hard material is forced into the collection cavity in this manner, a like volume of soft material present within the collection cavity, such as 214, 234, is displaced in a right-to-left direction back to the grinding surface of orifice plate 18. This results in a minimal amount of usable soft material being discharged with the hard material through the hard material discharge system, such as 210, 230, thus minimizing waste of usable material during grinding.

FIGS. 22 and 23 illustrate a flow-controlling nozzle arrangement, shown generally at 270, which is adapted for mounting to the end of a discharge tube such as 82, 238 or 258, or a flexible hose which may be connected to the end of such a discharge tube. Nozzle arrangement 270 can be employed either in connection with a system such as shown in FIGS. 17 and 21, which provide a restriction in the flow of hard material passing through the system, or with a system such as shown in FIGS. 1, 10 and 12, which do not provide a restriction to the discharge,of hard material.

Nozzle arrangement 270 consists generally of a valve body 272, which is substantially cylindrical, and includes an enlarged rear mounting portion 274 within which the outer end of a discharge tube, such as shown at 275, is secured. Valve body 252 defines an axial internal passage 276 which communicates with the interior of discharge tube 275 to receive discharged hard material therefrom. Valve body passage 276 defines an inlet end adjacent the outlet of discharge tube 275, and an outlet end which terminates in a nozzle discharge opening, over which a movable valve plate 278 is positioned. The nozzle discharge opening is substantially circular when viewed along the axis of passage 270. A seating surface, the lower portion of which is shown at 280 and the upper portion of which is shown at 282, is formed on valve body 270, with the nozzle discharge opening extending inwardly from the seating surface. The seating surface extends about the entire periphery of the nozzle discharge opening, and is oriented at an angle of approximately 45° to the longitudinal axis of passage 276. Valve plate 278 is movable between a closed position, as shown in FIG. 22 in which it lies in a plane substantially 45° to the longitudinal axis of passage 276, and an open position in which its lower free end, which is shown disposed against lower portion 280 of the seating surface, is moved away therefrom so as to establish communication between passage 276 and the exterior of valve body 270.

Valve plate 278 is formed integrally with a rearwardly extending elongated mounting member 284, which is provided with an upwardly extending lip 286 at its rearward end. Mounting member 284 is disposed within a channel 288 formed in the upper surface of valve body 270. A clamping plate 290 is positioned within channel 288 above mounting member 284. A clamping ring 292, having a set screw 294, is assembled onto valve body 270 to retain clamping plate 290 and mounting member 284 in position within channel 288, and to fix the position of clamping plate 290 relative to mounting member 284.

Clamping plate 290 and clamping ring 292 can be moved to varying positions within channel 288 along the length of mounting member 284. Positioning clamping plate 290 rearwardly such that its rearward end engages upwardly extending lip 286 provided on mounting member 284, and then securing clamping ring 292 so as to fix the position of clamping plate 290, results in clamping plate 290 and mounting member 284 cooperating to provide a minimal amount of resistance to valve plate 278 moving away from its closed position. On the other hand, moving clamping plate 290 to its position as shown in FIG. 22 and then securing clamping ring 292 in the illustrated position, results in clamping plate 290 and mounting member 284 cooperating to provide a maximum amount of resistance to movement of valve plate 278 away from its closed position.

When hard material is discharged from discharge tube 275 and into passage 276 of valve body 270, the hard material comes into contact with valve plate 278 prior to its discharge from valve body 270. When a sufficient amount of back pressure is built up within passage 276, clamping plate 278 is moved away from its closed position so as to allow the hard material to be discharged from the nozzle discharge opening formed in valve body 270. Movement of clamping plate 290 to its position as shown in FIG. 22 results in a maximum amount of resistance to movement of clamping plate 278 away from its closed position, to maintain a relatively high level of back pressure within passage 276 and discharge tube 275. This provides advantageous operation during grinding of meat with a large quantity of hard material, to insure that primarily hard material is discharged while a maximum amount of soft material is ground. Conversely, when hard material conditions are lighter, clamping plate 290 may be moved rearwardly so as to reduce the amount of resistance provided by clamping plate 258 to movement away from its closed position.

Figure 24:
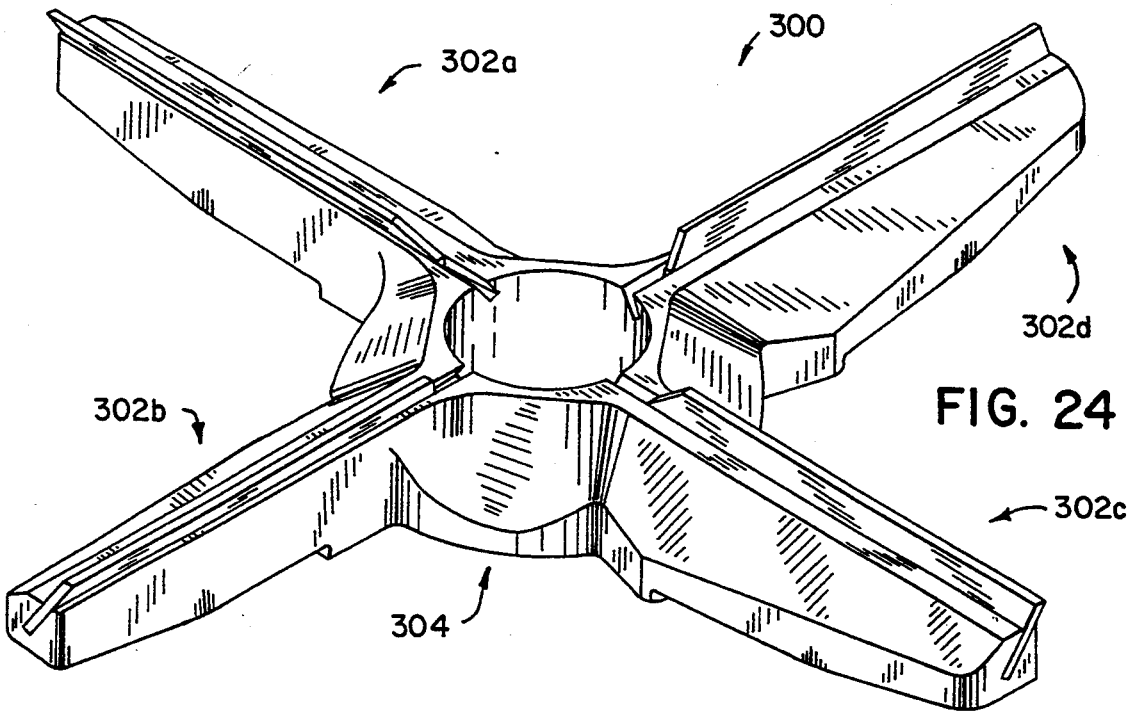
FIG. 24 is an isometric view of a knife holder assembly similar to FIG. 5, showing an alternative construction for the knife holder.
Figure 25:
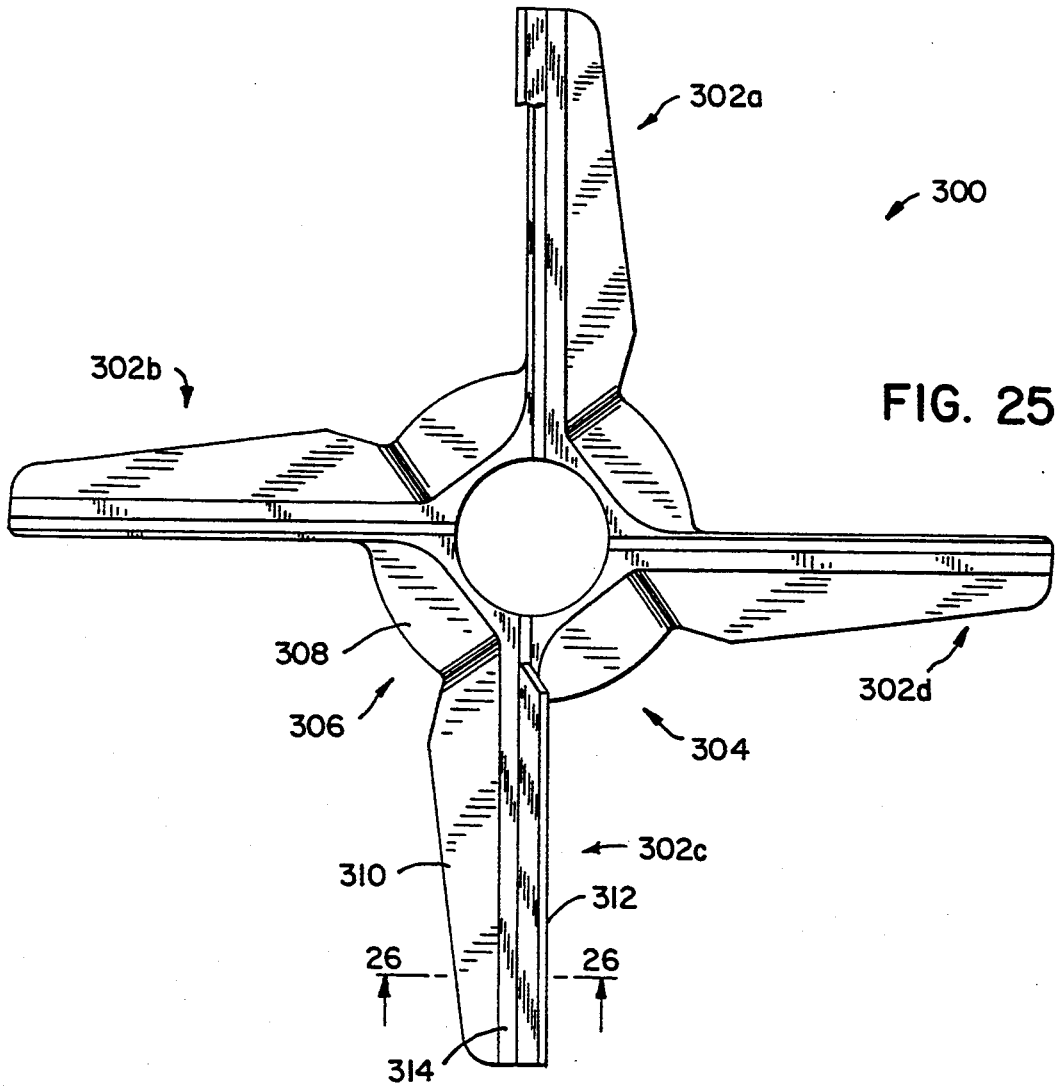
FIG. 25 is an end elevation view of the knife holder assembly of FIG. 24.

FIGS. 24 and 25 illustrate a knife assembly 300 which can be employed in place of knife assembly 16 (FIGS. 4, 5). Knife assembly 300 is adapted to be mounted at the end of feed screw 14 in a manner similar to that described previously. Knife assembly 300 includes a series of knife holding arms **302*a*–302*d*, which extend outwardly from a hub 304. As shown in FIG. 25, arms 302*a*–302*d* are oriented at a neutral rake, i.e. the leading edge of each arm is oriented substantially in line with a radius of a circumcircle defined by rotation of knife assembly 300. It has been found that in certain applications with certain products being ground, a neutral rake provides adequate supply of hard material through collection passages 32** without supplying excess usable material thereto.

Referring to arms **302*b*, 302*c* in FIGS. 24 and 25, a pocket 306 is formed in hub 304 between arms 302*b*, 302*c*, in a manner similar to the pockets (68*a*–68*d*) shown and described with respect to knife assembly 16. A similar such pocket is located between knife arms 302*c*, 302*d*; 302*d*, 302*a*; and 302*a*, 302*b*. It should be understood that the following description of pocket 306 and knife arms 302*b*, 302*c* applies with equal force to the remaining pockets and knife arms of knife assembly 300**.

Pocket 306 is defined by an angled outwardly facing surface 308, analogous to the angled outwardly facing surfaces (**70*a*–70*d*) of knife assembly 16. As before, pocket 306 functions to provide passage of hard material into collection passages 32, without restricting the flow of such hard material. Angled surface 308 is substantially aligned with collection passages 32 upon rotation of knife assembly 300**.

Knife arm **302*c* is provided with a rearwardly facing angled surface 310 (FIGS. 24–26). Angled surface 310 is located rearwardly of the knife, shown at 312, which is mounted to knife arm 302*c* in the same manner as described previously. Angled surface 310 is oriented at an angle of approximately 35° relative to the inner surface of knife arm 302*c*, shown at 314. Angled surface 310 extends throughout the length of knife arm 302*c*, and merges at its inner end with outwardly ramped area 308 of pocket 306**.

It is been found that, during operation when knife assembly 300 is rotating, the rearwardly angled surfaces, such as 310, in combination with the pockets, such as 306, define low-pressure areas to which hard material and fat migrate. The hard material and fat rides on the inner surface of orifice plate 18 during rotation of knife assembly 300, and subsequently is passed toward the center of orifice plate 18, which is the area of least pressure exerted by the righting of the auger. In a manner as discussed previously, such material is routed through the hard material discharge passages, such as 32, and into the hard material collection system. The space, such as 61 (FIG. 1), located outwardly of the outer ends of the knife arms provides a passage by which fat and hard material migrates to the low pressure areas for passage inwardly along the rearwardly angled surfaces, such as 310, toward the pockets, such as 308, and to the discharge passages 32.

Figure 27:
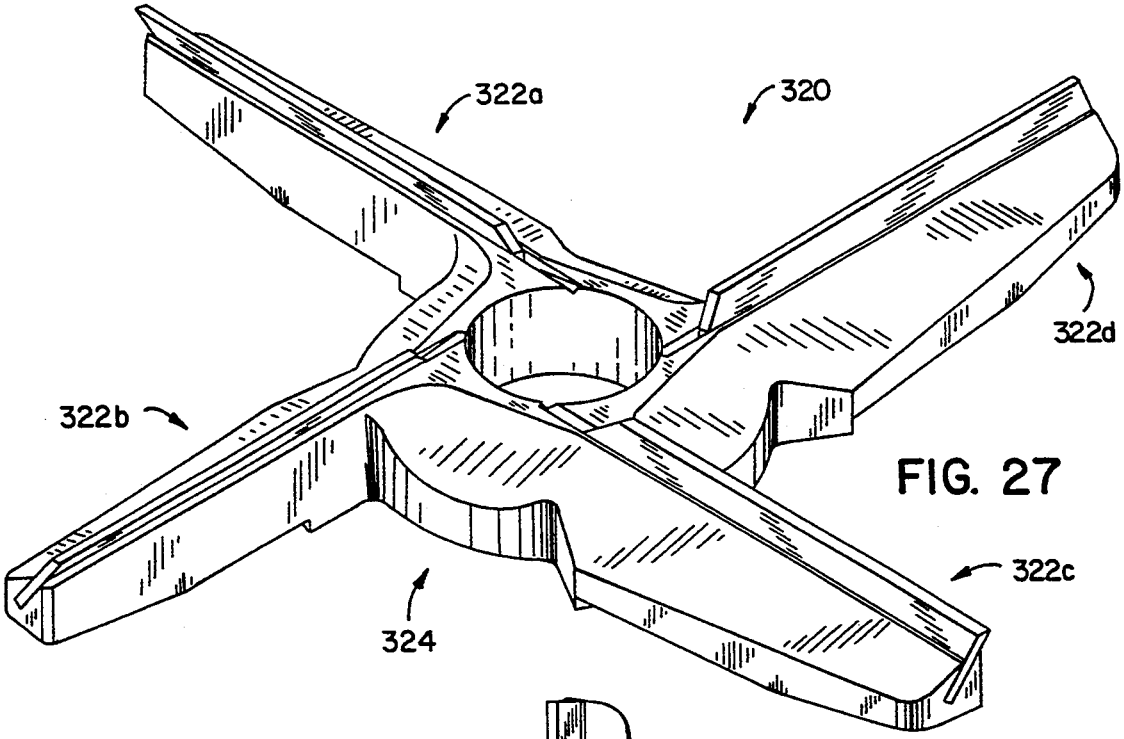
FIG. 27 is a view similar to FIGS. 5 and 24, showing yet another embodiment for the knife holder assembly of the invention.
Figure 28:
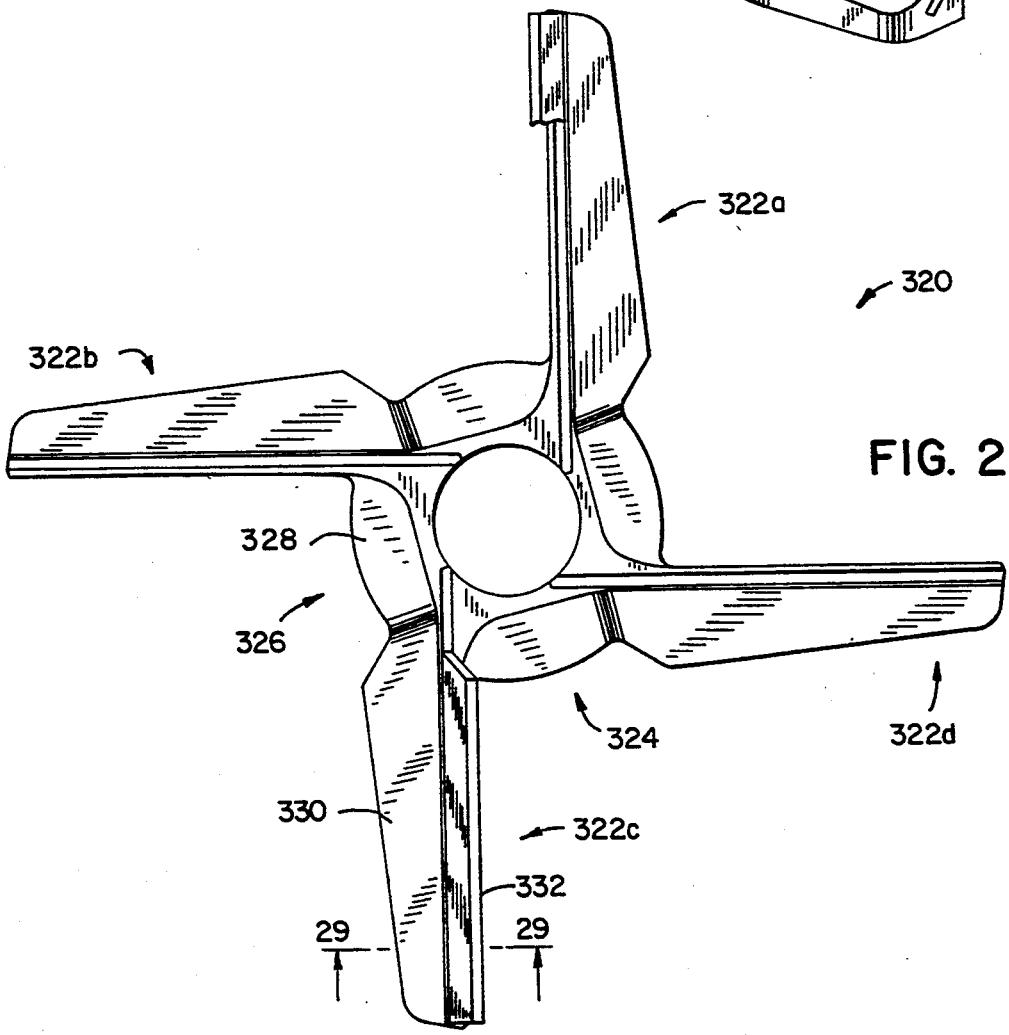
FIG. 28 is an end elevation view of the knife holder assembly of FIG. 27.

FIG. 27 illustrates a knife assembly 320 having a series of arms 322*a*, 322*b*, 322*c* and 322*d*, extending outwardly from a hub 324. Referring to FIG. 28, knife arms 322*a*, 322*b*, 322*c* and 322*d* are oriented at a positive rake relative to hub 324. This is similar to the orientation of knife arms 40*a*–40*d* in FIG. 4. Knife arms 322*a*–322*d* have a positive rake of approximately 7°, i.e. the leading face of each knife arm is at an angle of approximately 7° from a line drawn between the center of hub 324 and the outer leading tip of each knife arm. This construction, as described previously, acts to force material inwardly toward hub 324 during rotation of knife assembly 320.

As with knife assemblies 16 and 300, knife assembly 320 defines a series of pockets, such as shown at 326, between each of knife arms 322*a*–322*d*. Each pocket includes an outwardly facing area, such as 328.

Referring to FIGS. 28 and 29, each knife arm is provided with a rearwardly facing angled surface 330. Angled surface 330 extends rearwardly from a point just rearward of the knife, shown at 332, mounted to knife arm 322*c*, terminating at the rearward edge of knife arm 322*c*. Angled surface 330 is oriented at an angle of approximately 30° relative to the inner surface of knife arm 322*c*, shown at 334.

Angled surface 330 merges with ramped area 328 of pocket 326. In a manner as described with respect to knife assembly 300, angled surface 330 provides a low pressure area within which hard material and fat is collected upon rotation of knife assembly 320, whereby such material travels along the inner surface of orifice plate 18 toward the pockets, such as 326, and through the collection passages 32 in orifice plate 18.

Figure 30:
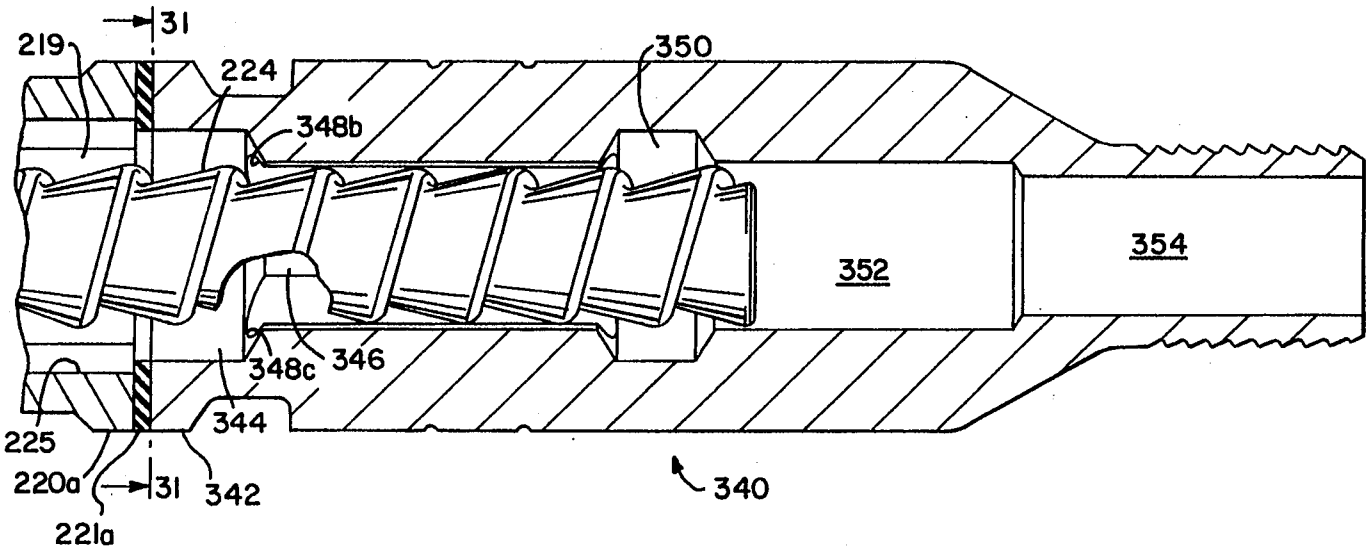
FIG. 30 is a partial section view showing an alternative embodiment for the discharge tube illustrated in FIG. 17.

FIG. 30 illustrates an alternative construction for adaptor tube 220 of FIG. 17, which is mounted to the mounting flange 220*a* of cup member 212. In FIG. 30, an adaptor member 340 is illustrated which replaces adaptor tube 220 of FIG. 17. Adaptor member 340 is constructed of a nylon or other such material, and includes a mounting flange 342 adapted to be secured to mounting flange 220*a*, with urethane gasket 221*a* therebetween, to secure adapted member 340 to cup member 212. An expansion chamber 344 is formed at the inlet to adaptor member 340, with a passage 346 extending downstream of chamber 344. Referring to FIG. 31, a series of semicircular radially spaced axial fluted passages 348*a*, 348*b*, 348*c* and 3468 open into discharge passage 346, extending throughout the length of passage 346 between upstream expansion chamber 344 and a downstream expansion chamber, shown at 350 (FIG. 30). Discharge auger 224 extends through upstream expansion chamber 344, passage 346 and expansion chamber 350, into a downstream discharge passage 352 which leads to an outlet passage 354 formed at the end of adapted member 340. A hose or other such conduit is adapted to be connected to the outlet end of adaptor member 340, for receiving material discharged through outlet passage 354.

In operation, tube adaptor 340 of FIG. 30 receives hard material from axial passage 219 of cup member 212, and flutes 225 opening into axial passage 219, at upstream expansion chamber 344. In chamber 344, the particles of hard material are allowed to reorient themselves due to the action of rotation of discharge auger 224, and are then passed into discharge passage 346 and flutes 348*a*–348*d*. Flutes 348*a*–348*d* function similarly to flutes 225 in axial passage 219, providing an axial flow path for the hard material, in combination with the rotating flow path defined by the flighting of discharge auger 224 upon its rotation. The hard material particles are discharged into downstream expansion chamber 350, where they are again allowed to reorient during rotation of discharge auger 224 prior to being supplied to downstream discharge passage 352 from the end of discharge auger 224. Discharge auger 224 generates sufficient pressure to force the discharged hard material particles through discharge passage 352 and outlet passage 354 and the conduit connected thereto, to a remote hard material collection receptacle.

As in the embodiment of FIG. 17, the inner wall of passage 346 is dimensioned so as to be in very close tolerance to the outermost extent of the flighting of discharge auger 224. The axial passageways provided by flutes 348*a*–348*d* serve to both prevent the hard material particles from spinning on the inner wall defining passage 346, and also to provide an axial passageway for such particles, while maintaining a sufficient amount of back pressure within cup member 212 without overly restricting the discharge of hard material.

The flighting of auger 224, and flutes 348*a*–348*d*, provide a predetermined flow rate for continuous discharge of hard material. When it is desired to increase the flow rate of hard material, such as when hard material conditions are heavier, it is only necessary to substitute a new discharge auger 224 having a greater diameter and/or pitch and/or flighting depth, along with a new adaptor member 340 having an increased diameter of passage 246 and/or depth of flutes 348*a*–348*b*, to increase the flow rate of the continuous hard material discharge. The converse applies when it is desired to decrease the continuous flow rate of discharged hard material. In this manner, a processor need only purchase enough discharge auger/adaptor member sets to accommodate typical hard material conditions encountered for the different products normally ground. Accordingly, any operator error in controlling flow rate of hard material is eliminated.

Figure 32:
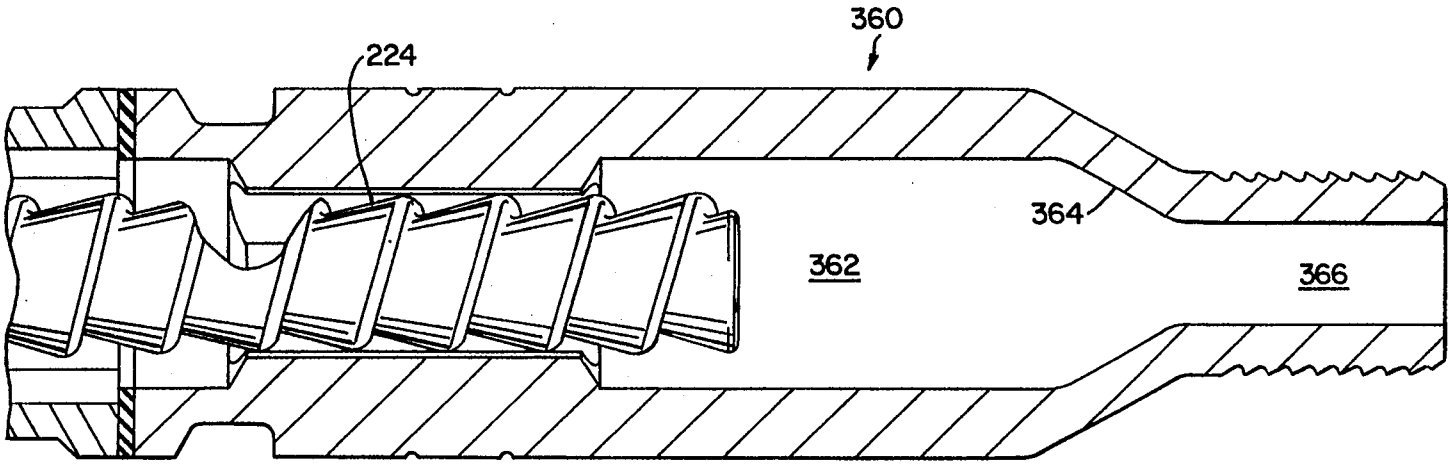
FIG. 32 is a view similar to FIG. 30, showing yet another embodiment for the discharge tube.

FIG. 32 illustrates an adaptor member 360, the upstream end of which is constructed identically to adaptor member 340. Adjacent the end of discharge auger 224, adaptor member 360 defines an expansion chamber 362, into which the hard material is discharged upon rotation of discharge auger 224. Expansion chamber 362 is substantially longer than expansion chamber 350 of adaptor member 340, extending to a necked down area 364 which leads to an outlet passage 366. It has been found that the additional length provided to the expansion chamber, such as 362, also provides adequate and satisfactory operation for discharging hard material particles upon rotation of discharge auger 224.

The advantages offered by the invention in collecting hard material and recovering collected soft material allows an operator to use a lower grade of meat to be ground which typically includes a greater amount of hard material than does a higher grade of meat. Accordingly, the operator can reduce the cost of producing ground meat by employing a lower grade of material, while yielding a final ground meat product which is comparable in quality to that attained with use of a higher grade raw material in a prior art system.

Various alternatives and embodiments are contemplated as being within the scope of the following claims, particularly pointing out and distinctly claiming the subject matter regarded as the invention.

I claim:

1. A grinder for use in grinding soft material which comprises a mixture of soft material and hard material, comprising:

a housing having an inlet and an outlet;

an orifice plate located at the housing outlet having a plurality of relatively small grinding orifices and a plurality of relatively large hard material collection passages located inwardly of the grinding orifices;

an advancing arrangement for moving the mixture of material through the housing toward the orifice plate; and a rotatable knife assembly located adjacent a surface of the orifice plate, and including a central hub, a plurality of knife holding arms extending outwardly from the hub, each arm defining a forward surface and a rearward surface adjacent the hub, and a knife mounted to each knife holding arm;

wherein the central hub of the knife assembly defines a plurality of collection pockets, each collection pocket being located between adjacent knife holding arms, each collection pocket being in axial alignment with the hard material collection passages in the orifice plate and extending substantially entirely between the forward surface of one of the knife holding arms and the rearward surface of the adjacent knife holding arm.

2. The grinder of claim 1, wherein each collection pocket includes an outwardly facing ramped area located forwardly of one of the knife holding arms, wherein a longitudinal axis of each collection passage intersects each outwardly facing ramped area during rotation of the knife assembly.

3. The grinder of claim 2, wherein each knife holding arm includes a rearwardly facing ramped surface located rearwardly of each knife.

4. The grinder of claim 3, wherein the rearwardly facing ramped surface of each knife holding arm merges with the outwardly facing ramped area of an adjacent one of the collection pockets.

5. A knife holder for use in a grinder, comprising a central hub and a plurality of knife holding arms extending outwardly from the hub, each arm defining a forward surface and a rearward surface adjacent the hub and further defining an outer surface, wherein the central hub defines a plurality of collection pockets, each collection pocket extending substantially entirely between adjacent knife holding arms and extending substantially entirely between the forward surface of one of the knife holding arms and the rearward surface of the adjacent knife holding arm, each collection Docket being disposed inwardly of the outer surface defined by adjacent arms, wherein each collection pocket includes an outwardly facing ramped area located forwardly of one of the knife holding arms.

6. The knife holder of claim 5, wherein each knife holding arm includes a rearwardly facing ramped surface throughout substantially the entire length of the knife holding arm.

7. The knife holding arm of claim 6, wherein the rearwardly facing ramped surface of each knife holding arm merges with the outwardly facing ramped area of the collection pocket adjacent the knife holding arm.

* * * * *

UNITED STATES PATENT AND TRADEMARK OFFICE

CERTIFICATE OF CORRECTION

PATENT NO. : 5,405,095

DATED : April 11, 1995

INVENTOR(S) : NICK J. LESAR

It is certified that error appears in the above-identified patent and that said Letters Patent is hereby corrected as shown below:

On the title page, item [54] and in column 1, line 3, in the title delete "HAND" and substitute therefor —HARD—.

In The Claims

Claim 5, col. 26, line 27, delete "Docket" and substitute therefor -- pocket --.

Signed and Sealed this

Eleventh Day of July, 1995

*Attest:*

*Attesting Officer*

Bruce Lehman

BRUCE LEHMAN

*Commissioner of Patents and Trademarks*